US007889157B2

(12) United States Patent
Lee et al.

(10) Patent No.: US 7,889,157 B2
(45) Date of Patent: Feb. 15, 2011

(54) ELECTRO-LUMINESCENCE DISPLAY DEVICE AND DRIVING APPARATUS THEREOF

(75) Inventors: Dai Yun Lee, Kyounggi-do (KR); Han Sang Lee, Kyounggi-do (KR); Sang Soo Han, Kyounggi-do (KR)

(73) Assignee: LG Display Co., Ltd., Seoul (KR)

( * ) Notice: Subject to any disclaimer, the term of this patent is extended or adjusted under 35 U.S.C. 154(b) by 1581 days.

(21) Appl. No.: 10/825,242

(22) Filed: Apr. 16, 2004

(65) Prior Publication Data

US 2005/0140596 A1 Jun. 30, 2005

(30) Foreign Application Priority Data

Dec. 30, 2003 (KR) ..... 10-2003-0099938
Dec. 30, 2003 (KR) ..... 10-2003-0100844

(51) Int. Cl.
*G09G 3/30* (2006.01)

(52) U.S. Cl. ..... 345/76; 345/204

(58) Field of Classification Search ..... 345/76, 345/204, 212
See application file for complete search history.

(56) References Cited

U.S. PATENT DOCUMENTS

| | | | | |
|---|---|---|---|---|
| 5,021,774 | A | 6/1991 | Ohwada et al. | |
| 6,147,665 | A | 11/2000 | Friedman | 345/75.2 |
| 6,389,057 | B1 | 5/2002 | Haartsen | |
| 6,531,827 | B2 | 3/2003 | Kawashima | |
| 6,989,826 | B2 | 1/2006 | Kasai | |
| 7,113,156 | B2 | 9/2006 | Hashimoto | |
| 7,151,536 | B2 * | 12/2006 | Kasai | 345/212 |
| 2002/0175635 | A1 | 11/2002 | Komiya | |
| 2002/0196211 | A1 | 12/2002 | Yumoto | 345/76 |
| 2003/0001828 | A1 | 1/2003 | Asano | 345/204 |
| 2003/0006713 | A1 | 1/2003 | Kim et al. | |
| 2003/0030602 | A1 * | 2/2003 | Kasai | 345/76 |
| 2003/0038760 | A1 | 2/2003 | Kim et al. | |
| 2003/0156101 | A1 | 8/2003 | LeChevalier | |
| 2003/0173904 | A1 | 9/2003 | LeChevalier | |
| 2004/0108998 | A1 | 6/2004 | Imamura | |
| 2004/0169623 | A1 * | 9/2004 | Fujita | 345/76 |

FOREIGN PATENT DOCUMENTS

| | | | |
|---|---|---|---|
| CN | 1355516 | | 6/2002 |
| DE | 19821914 | A1 | 11/1998 |
| DE | 102224737 | A1 | 4/2003 |
| EP | 1130565 | A1 | 9/2001 |
| EP | 1282104 | A1 | 2/2003 |
| JP | 2003-076327 | | 3/2003 |
| JP | 2003-114644 | | 4/2003 |
| JP | 2003-114645 | | 4/2003 |
| JP | 2003-295828 | | 10/2003 |
| TW | 520613 | B | 2/2003 |
| WO | WO 03/091980 | A1 | 11/2003 |
| WO | WO 3/023752 | A1 | 3/2004 |

* cited by examiner

*Primary Examiner*—Amare Mengistu
*Assistant Examiner*—Yuk Chow
(74) *Attorney, Agent, or Firm*—Morgan Lewis & Bockius LLP

(57) ABSTRACT

An electro-luminescence display device includes: pixels provided between data lines and scan lines, each of the pixels including a light-emitting cell driven with a current; and a current controller for temporarily increasing the current for driving the light-emitting cells.

19 Claims, 25 Drawing Sheets

ELECTRO-LUMINESCENCE DISPLAY DEVICE AND DRIVING APPARATUS THEREOF

The present invention claims the benefit of Korean Patent Application No. 2003-100844 filed in Korea on Dec. 30, 2003 and Korean Patent Application No. 2003-99938 filed in Korea on Dec. 30, 2003, which are hereby incorporated by reference.

BACKGROUND OF THE INVENTION

1. Field of the Invention

This invention relates to an electro-luminescence display (ELD), and more particularly to the driving of an electro-luminescence display device.

2. Description of the Related Art

Flat panel display devices have the advantages of reduced weight and reduced bulk over cathode ray tube (CRT) devices. Such flat panel display devices include a liquid crystal display (LCD), a field emission display (FED), a plasma display panel (PDP) and an electro-luminescence (EL) display, etc. In particular, the EL display device is a self-luminous device capable of light-emission by a re-combination of electrons with holes in a phosphorescent material. EL display devices are generally classified into inorganic EL devices that use an inorganic compound as a phosphorescent material and organic EL devices that use an organic compound as a phosphorescent material. An EL display device has the advantages of low driving voltage, self-luminescence, thin profile, wide viewing angle, fast response speed, and high contrast.

The organic EL device includes an electron injection layer, an electron carrier layer, a light-emitting layer, a hole carrier layer and a hole injection layer. When a predetermined voltage is applied between an anode and a cathode in the organic EL device, electrons produced from the cathode are moved via the electron injection layer and the electron carrier layer into the light-emitting layer while holes produced from the anode are moved via the hole injection layer and the hole carrier layer into the light-emitting layer. The electrons and the holes respectively fed from the electron carrier layer and the hole carrier layer re-combine at the light-emitting layer so as to emit light.

FIG. 1 is a schematic block diagram showing a configuration of a related art electro-luminescence display device. As shown in FIG. 1, an active matrix type EL display device includes an EL panel 20 having pixels 28 arranged between scan lines SL and data lines DL, a scan driver 22 for driving the scan lines SL of the EL panel 20, a data driver 24 for driving the data lines DL of the EL panel 20, a gamma voltage generator 26 supplying the data driver 24 with a plurality of gamma voltages, and a timing controller 27 for controlling the data driver 24 and the scan driver 22. The EL panel 20 has pixels 28 arranged in a matrix. Further, the EL panel 20 has a feeding pad 10 supplied with a supply voltage from an external voltage supply source VDD and a ground pad 12 supplied with a ground voltage from an external ground voltage source GND. For example, the supply voltage source VDD and the ground voltage source GND may be incorporated from a power supply. The supply voltage from the feeding pad 10 is fed into each pixel 28. The ground voltage from the ground pad 12 is also fed into each pixel 28.

As also shown in FIG. 1, an active matrix type EL display device includes peripheral devices to the EL panel 20. A scan driver 22 applies a scanning pulse to the scan lines SL to sequentially drive the scan lines SL. A gamma voltage generator 26 applies gamma voltages having various voltage values to the data driver 24. A data driver 24 converts a digital data signal from the timing controller 27 into an analog data signal using a gamma voltage from the gamma voltage generator 26. A data driver applies the analog data signal to the data lines DL whenever the scanning pulse is supplied. A timing controller 27 generates a data control signal for controlling the data driver 24 and a scan control signal for controlling the scan driver 22 using synchronizing signals fed from an external system (e.g., a graphic card). The data control signal generated from the timing controller 27 is applied to the data driver 24 thereby controlling the data driver 24. The scan control signal generated from the timing controller 27 is applied to the scan driver 22 to thereby control the scan driver 22. Furthermore, the timing controller 27 applies the digital data signal from the external system to the data driver 24.

FIG. 2 is a detailed circuit diagram of the pixel shown in FIG. 1. Each of the pixels 28 receives the data signal from the data line DL when the scanning pulse is applied to the scan line SL to thereby generate a light corresponding to the data signal. To this end, as shown in FIG. 2, each pixel 28 includes an EL cell OEL having a cathode connected to the ground voltage source GND (i.e., a voltage supplied from the ground pad 12), and a cell driver 30 connected to the scan line SL, the data line DL and the supply voltage source VDD (i.e., a voltage supplied from the feeding pad 10) and to the anode of the EL cell OEL to drive the EL cell OEL. The cell driver 30 includes a switching thin film transistor T1 having a gate terminal connected to the scan line SL, a source terminal connected to the data line DL and a drain terminal connected to a first node N1, a driving thin film transistor T2 having a gate terminal connected to the first node N1, a source terminal connected to the supply voltage source VDD and a drain terminal connected to the EL cell OEL, and a capacitor C connected between the supply voltage source VDD and the first node N1.

FIG. 3 is a waveform diagram for describing a procedure of driving the scan line and the data line. The switching thin film transistor T1 is turned on when a scanning pulse is applied to the scan line SL, to thereby apply a data signal to the data line DL to the first node N1. The data signal supplied to the first node N1 is charged into the capacitor C and applied to the gate terminal of the driving thin film transistor T2. The driving thin film transistor T2 controls a current amount I fed from the supply voltage source into the EL cell OEL in response to the data signal applied to the gate terminal thereof, thereby controlling a light-emission amount of the EL cell OEL. Further, since the data signal is discharged from the capacitor C even though the switching thin film transistor T1 is turned off, the driving thin film transistor T2 applies a current I from the supply voltage source VDD until a data signal at the next frame is supplied, to thereby keep an emission of the EL cell OEL.

The driving of the related art EL display device, as described above, has a problem in that a parasitic capacitor exists in the data line DL that causes a deterioration of picture quality. Moreover, such a picture quality deterioration phenomenon becomes particularly serious when a low gray level is supposed to be displayed. More specifically, various parasitic capacitors generally exist in the data line DL. The data line DL may have a parasitic capacitance with the scan line SL. There may also be a parasitic capacitance between the upper substrate (not shown) and the data line DL. Further, a parasitic capacitance can exist between adjacent data lines. Furthermore, a parasitic capacitance can exist between the data line DL and the EL cell OEL. The total parasitic capacitance existing for the data line DL can be approximately 50 to 100 times higher than the capacitance C of the pixel 28.

The parasitic capacitance in the data line DL of a related art EL device can delay a discharge time of a voltage (or current) charged in the pixel 28 upon display of the picture to thereby cause a failure in obtaining a desired picture. Further, the related art EL display device has a limit in controlling a low driving current applied to the light-emitting cell OEL. More particularly, the related art EL device has a limit in charging or discharging the capacitor C of the pixel 28 because the parasitic capacitance of the data DL negatively effects the application of current to the light-emitting cell OEL when a picture is implemented.

SUMMARY OF THE INVENTION

Accordingly, the present invention is directed to an electro-luminescence display device and driving apparatus thereof that substantially obviates one or more of the problems due to limitations and disadvantages of the related art.

An object of the present invention is to provide an electro-luminescence display device and a driving apparatus to reducing the pixel driving time.

Another object of the present invention is to provide an electro-luminescence display device and a driving apparatus to effectively charge and discharge a pixel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an electro-luminescence display device includes: pixels provided between data lines and scan lines, each of the pixels including a light-emitting cell driven with a current; and a current controller for temporarily increasing the current for driving the light-emitting cells.

In another aspect, an electro-luminescence display device includes: an electro-luminescence panel including a pixel defined by a data line for receiving data signals crossing a scan line for receiving scan signals; and a current amplifier connected to one terminal of the data line to apply an amplified current made by amplifying an input current prior to an input of the data signals to the data line.

In yet another aspect, a method of driving an electro-luminescence display device having pixels at intersections between data lines and scan lines and including light-emitting cells driven with a current includes the steps of sequentially sampling data signals applied to the data lines in a time interval when a scanning pulse is applied to the Nth scan line and storing them into a plurality of first sample holders, and temporarily increasing a current flowing in the light-emitting cell largely using the data signals stored in the plurality of first sample holders in a time interval when the scanning pulse is applied to the (N+1)th scan line.

In yet another aspect, a method of driving an electro-luminescence display device includes the steps of selecting scan lines of an electro-luminescence panel to input gate signals, inputting data signals to data lines crossing the scan lines to define pixels, and inputting an amplifying current to the data lines prior to an input of the data signal such that the data line has a potential close to the data signal.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
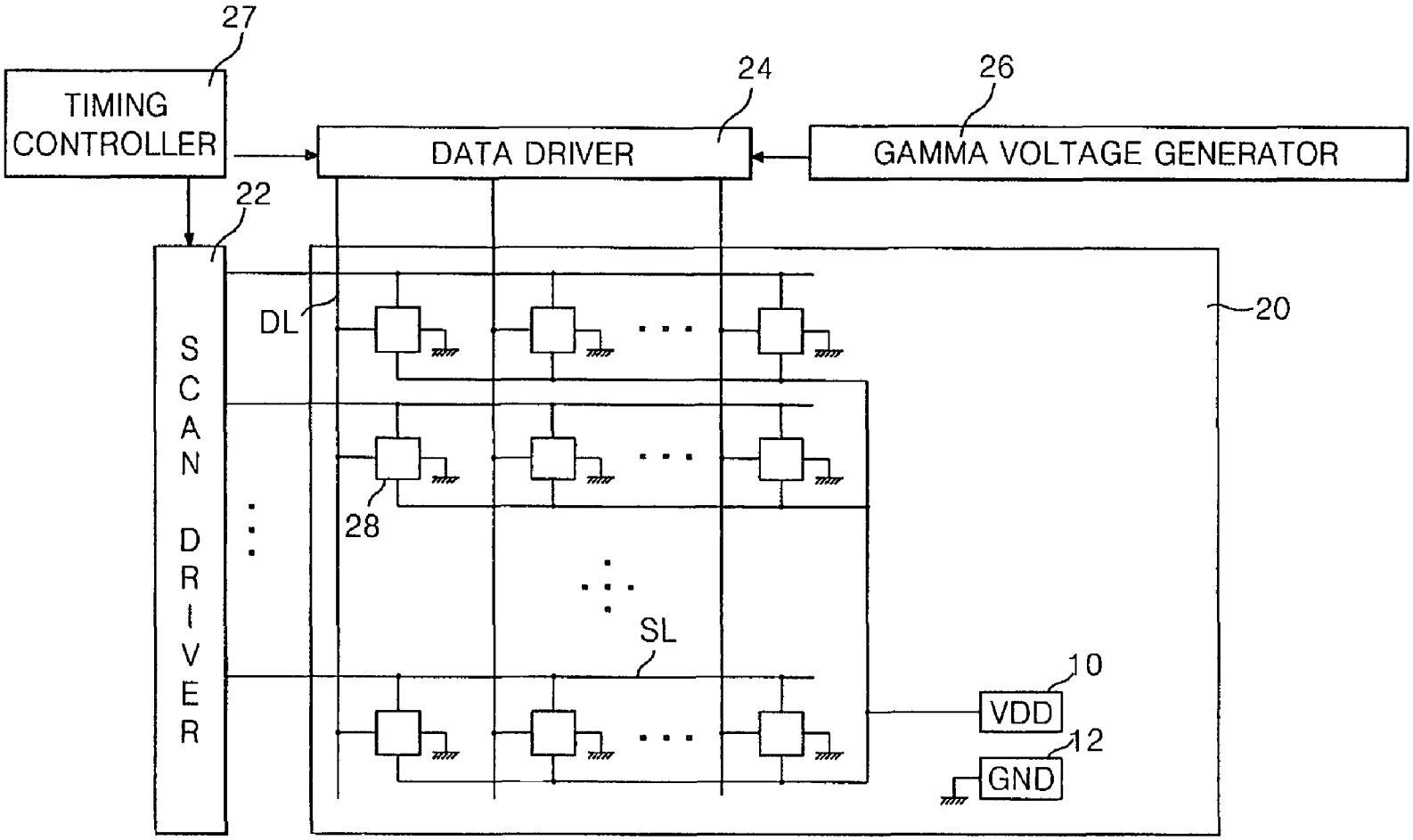
FIG. 1 RELATED ART
FIG. 1 is a schematic block diagram showing a configuration of a related art electro-luminescence display device.
Figure 2:
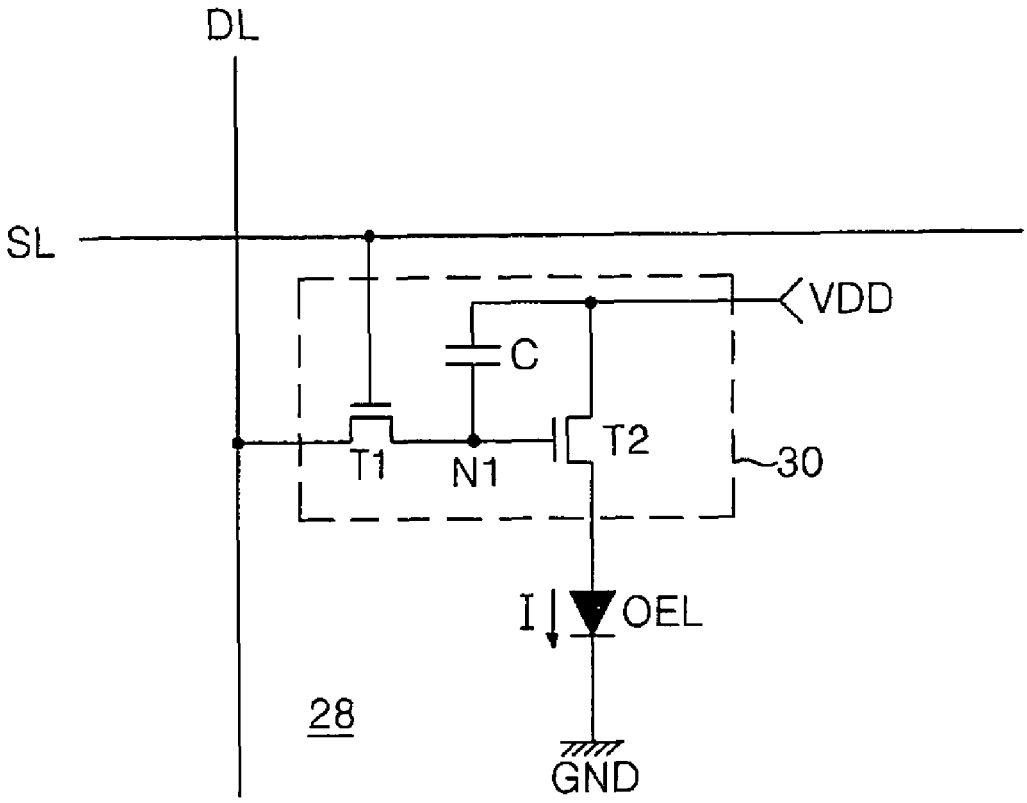
FIG. 2 RELATED ART
FIG. 2 is a detailed circuit diagram of the pixel shown in FIG. 1.
Figure 3:
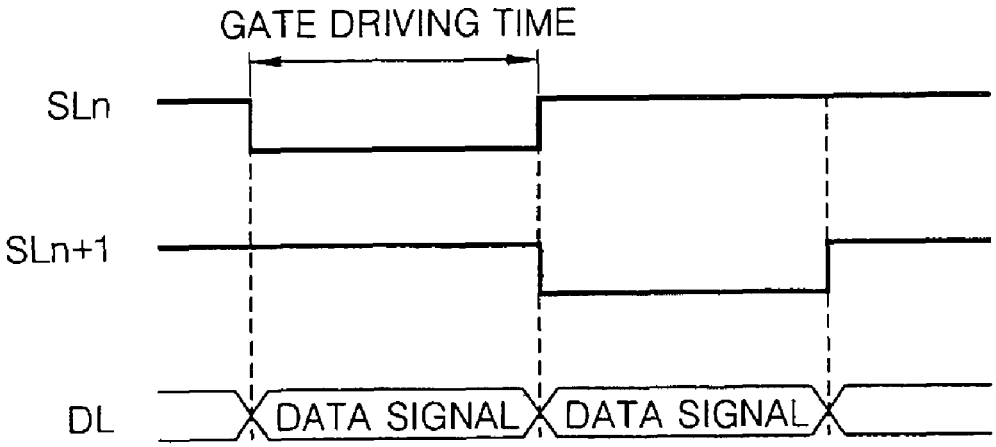
FIG.3 RELATED ART
FIG. 3 is a waveform diagram for describing a procedure of driving the scan line and the data line.
Figure 4:
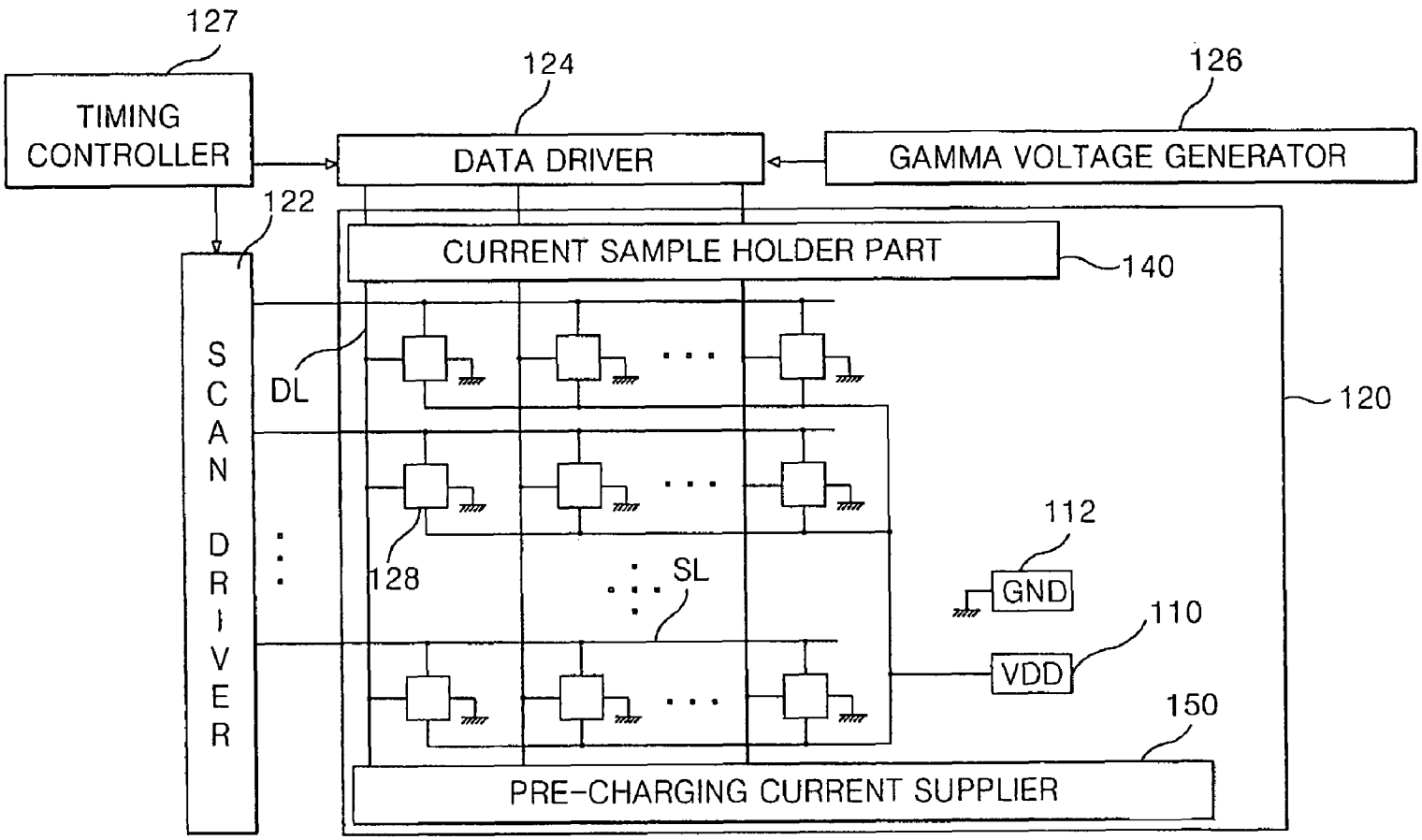
FIG. 4 is a schematic block diagram showing a configuration of an electro-luminescence display device according to a first embodiment of the present invention.

FIG. 4 is a schematic block diagram showing a configuration of an electro-luminescence display device according to a first embodiment of the present invention. Referring to FIG. 4, an electro-luminescence (EL) display device according to an embodiment of the present invention includes an EL panel 120 having pixels 128 arranged between scan lines SL and data lines DL. A scan driver 122 drives the scan lines SL of the EL panel 120. A data driver 124 drives the data lines DL of the EL panel 120. A gamma voltage generator 126 supplies the data driver 124 with a plurality of gamma voltages. A current sample holder portion 140 is connected between the data driver 124 and the data line DL to pre-charge a driving current fed to the pixels 128. A pre-charging current supplier 150 is connected to the end of the data line DL to supply a pre-charging current to the data line DL. A timing controller 127 controls the data driver 124 and the scan driver 122. The current sample holder portion 140 and the pre-charging current supplier 150 are configured as a current controller for temporarily raising a driving current supplied to the pixels 128. The EL panel 120 has pixels 128 arranged in a matrix. Further, the EL panel 120 is provided with a feeding pad 110 supplied with a supply voltage from an external voltage supply source VDD and a ground pad 112 supplied with a ground voltage from an external ground voltage source GND. For example, the supply voltage source VDD and the ground voltage source GND may be incorporated from a power supply. The supply voltage from the feeding pad 110 is fed into each pixel 128. The ground voltage from the ground pad 112 is also fed into each pixel 128.

Figure 6:
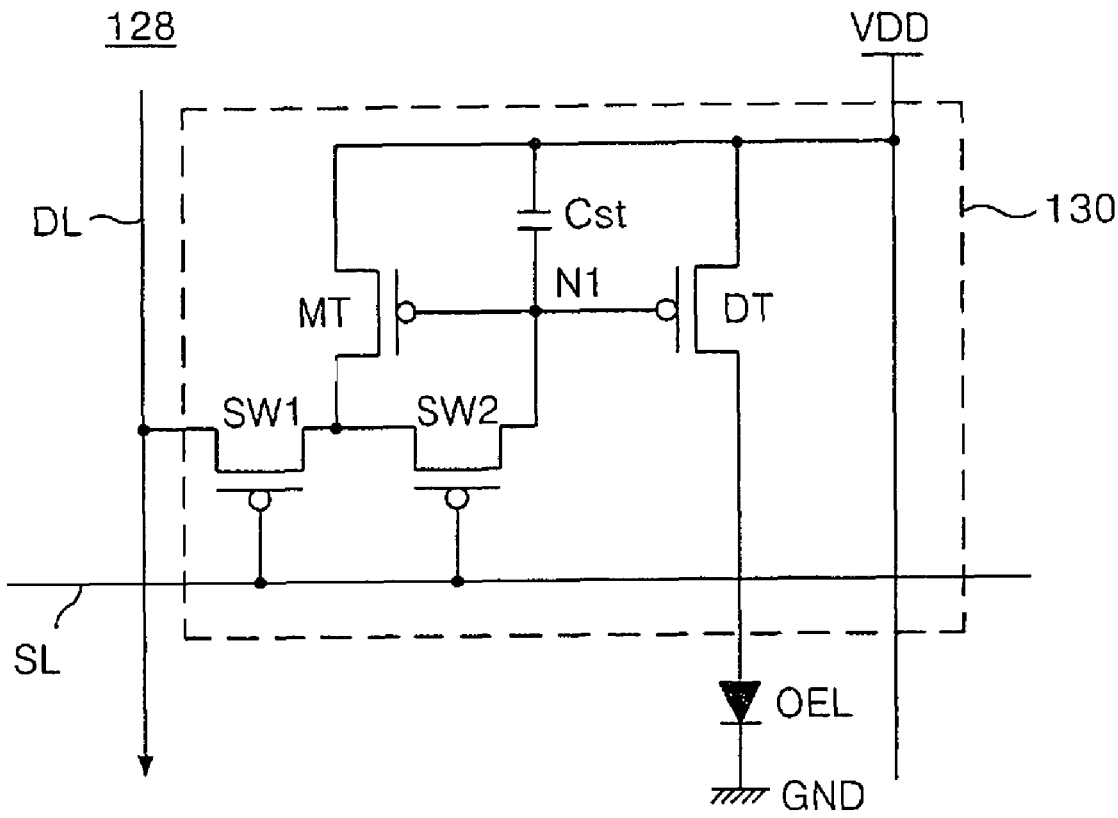
FIG. 6 is an equivalent circuit diagram of the pixel shown in FIG. 4.

As also shown in FIG. 4, an electro-luminescence (EL) display device includes peripheral devices to the EL panel 120. A scan driver 122 applies a scanning pulse to the scan lines SL to sequentially drive the scan lines SL. A gamma voltage generator 126 applies gamma voltages having various voltage values to the data driver 124. A data driver 124 converts a digital data signal from the timing controller 127 into an analog data signal using a gamma voltage from the gamma voltage generator 126. The data driver 124 applies the analog data signal to the data lines DL whenever the scanning pulse is supplied. A timing controller 127 generates a data control signal for controlling the data driver 124 and a scan control signal for controlling the scan driver 122 using synchronizing signals fed from an external system (e.g., a graphic card). A data control signal generated from the timing controller 127 is applied to the data driver 124, thereby controlling the data driver 124. A scan control signal generated from the timing controller 127 is applied to the scan driver 122, thereby controlling the scan driver 122. Further, the timing controller 127 applies the digital data signal from the external system to the data driver 124. Furthermore, the timing controller 127 generates a pre-charging enable signal EN, first to sixth selection signals S1 to S6 and a pre-charging selection signal PS, as shown in FIG. 6, to control a driving of the current sample holder portion 140 and the pre-charging current supplier 150.

Figure 5:
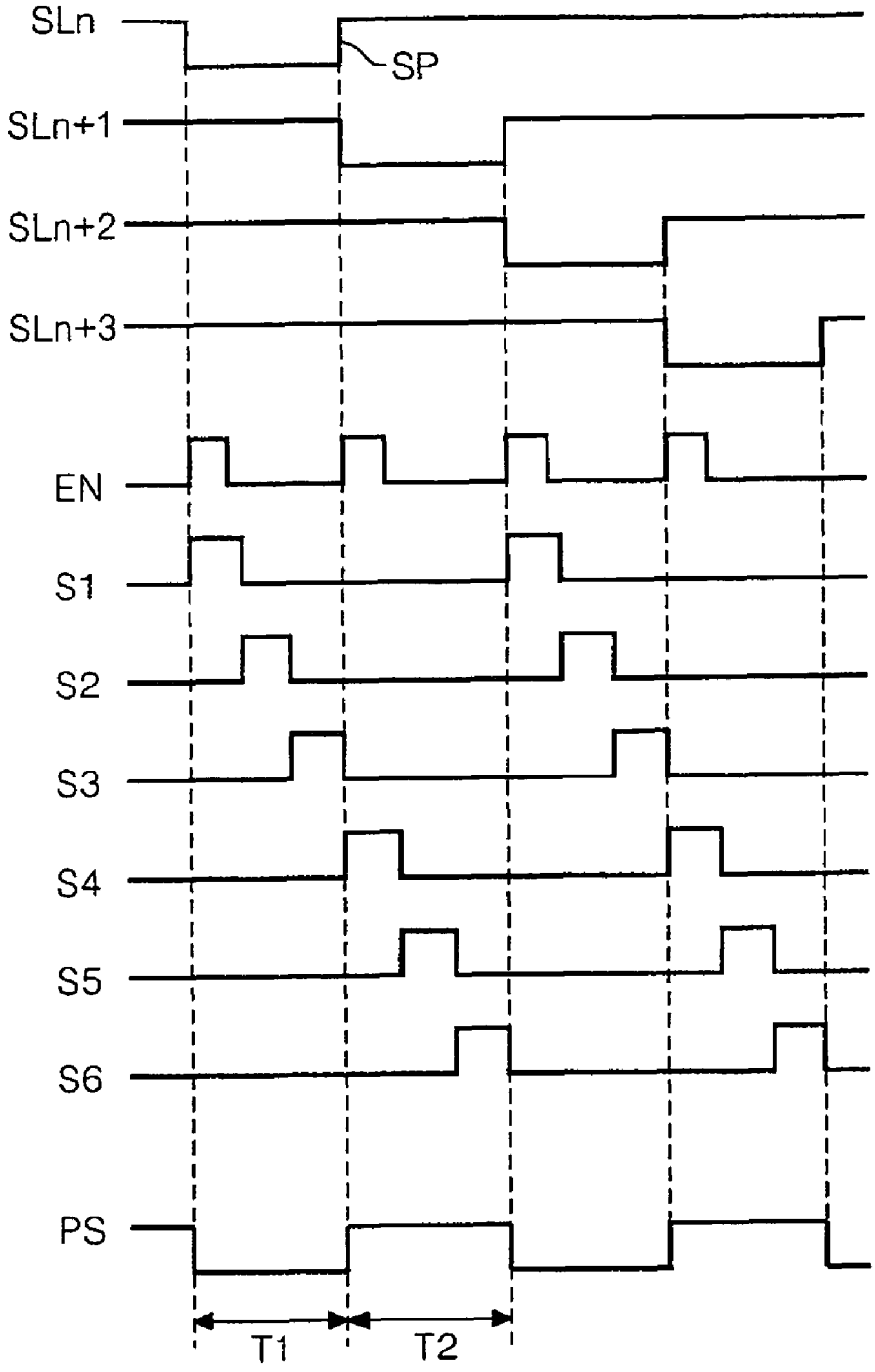
FIG. 5 is a waveform diagram of various driving signals generated from the timing controller shown in FIG. 4.

FIG. 5 is a waveform diagram of various driving signals generated from the timing controller shown in FIG. 4. The first to third selection signals S1, S2 and S3, of the first to sixth selection signals S1 to S6, are sequentially turned on in an ON period of a scanning pulse SP applied to the Nth scan line SLn. Thus, each of the first to third selection signals S1, S2 and S3 is in an ON state during the ⅓ interval of the ON period of the scanning pulse SP applied to the Nth scan line SLn while being in an OFF state during the remaining interval. Further, the first to the third selection signals S1, S2 and S3 are turned off in an ON period of the scanning pulse SP applied to the (N+1)th scan lines SLn+1.

On the other hand, the fourth to sixth selection signals S4, S5 and S6 of the first to sixth selection signals S1 to S6 are sequentially turned on in the ON period of the scanning pulse SP applied to the (N+1)th scan line SLn+1. Thus, each of the fourth to sixth selection signals S4, S5 and S6 is in an ON state during the ⅓ interval of the ON period of the scanning pulse SP applied to the (N+1)th scan line SLn+1 while being in an OFF state during the remaining interval. Further, the fourth to the sixth selection signals S4, S5 and S6 are turned off in an ON period of the scanning pulse SP applied to the Nth scan lines SLn.

The pre-charging enable signal EN has a voltage level in an ON state during a predetermined time from a falling edge of the scanning pulse SP. In other words, a width in the ON period of the pre-charging enable signal EN is smaller than in the ON state of each of the first to sixth selection signals S1 to S6. The pre-charging selection signal PS is turned off in the ON period of the scanning pulse SP applied to the (N+1)th scan line SLn+1 while being turned on in the ON period of the scanning pulse SP applied to the Nth scan line SLn. For explanation purposes, a pixel 128 can be equivalently expressed as a diode located adjacent to the crossing of a data line DL and a scan line SL. Each pixel 128 receives a data signal from the data line DL when the scanning pulse is applied to the scan line SL corresponding to the pixel to thereby generate a light corresponding to the data signal.

FIG. 6 is an equivalent circuit diagram of the pixel shown in FIG. 4. As shown in FIG. 6, each pixel 128 includes a supply voltage source VDD, a light-emitting cell OEL connected between the supply voltage source VDD and a ground voltage source GND, and a light-emitting cell driving circuit 130 for driving the light-emitting cell OEL in response to a driving signal from the data line DL and a scanning pulse from the scan line SL. The light-emitting driving circuit 130 includes a driving thin film transistor (TFT) DT connected between the supply voltage source VDD and the light-emitting cell OEL, a first switching TFT SW1 connected to the scan line SL and the data line DL, a second switching TFT SW2 connected to the first switching TFT SW1 and the scan line SL, a conversion TFT MT connected to a node positioned between the first switching TFT SW1 and the second switching TFT SW2, and the supply voltage source VDD to form a current mirror circuit with the driving TFT DT, thereby converting a current into a voltage. A storage capacitor Cst is connected to a gate terminal of the driving TFT DT and the conversion TFT MT. The TFTs can be a p-type electron metal-oxide semiconductor field effect transistor (MOSFET).

As also shown in FIG. 6, the gate terminal of the driving TFT DT is connected to the gate terminal of the conversion TFT MT while the source terminal of the driving TFT DT is connected to the supply voltage source VDD. The drain terminal thereof of the driving TFT DT is connected to the light-emitting cell OEL. The source terminal of the conversion TFT MT is connected to the supply voltage source VDD. The drain terminal of the conversion TFT MT is connected to both the drain terminal of the first switching TFT SW1 and the source terminal of the second switching TFT SW2. The source terminal of the first switching TFT SW1 is connected to the data line DL, and the drain terminal of the first switching TFT SW1 is connected to the source terminal of the second switching TFT SW2. The drain terminal of the second switching TFT SW2 is connected to a gate terminal of each of the driving TFT DT and the conversion TFT MT and the storage capacitor Cst. The gate terminals of the first switching TFT SW1 and second switching TFT SW2 are connected to the scan line SL. It is presumed that the conversion TFT MT and the driving TFT DT have the same characteristics because they are provided adjacently to each other to form a current mirror circuit such that a current amount flowing in the conversion TFT MT becomes equal to a current amount flowing in the driving TFT DT.

Figure 7:
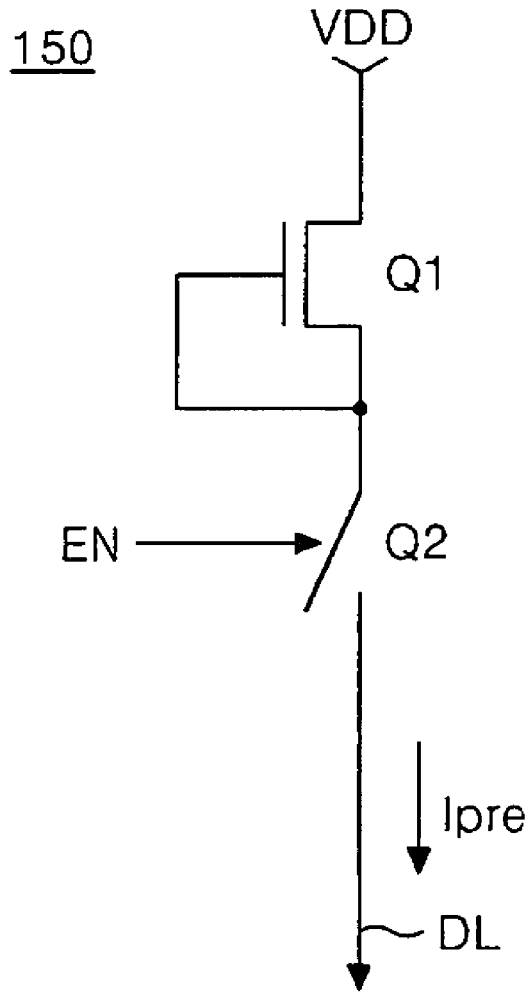
FIG. 7 is a circuit diagram of the pre-charging current supplier shown in FIG. 4.

FIG. 7 is a circuit diagram of the pre-charging current supplier shown in FIG. 4. As shown in FIG. 7, the pre-charging current supplier 150 includes a current supply TFT Q1 and a current switching device Q2 connected in series to the supply voltage source VDD and another end of the supply line DL. The source terminal of the current supply TFT Q1 is connected to the supply voltage source VDD, and the gate terminal and the drain terminal thereof are commonly connected to the first input terminal of the current switching device Q2. The current supply TFT Q1 is connected in a diode configuration between the supply voltage source VDD and the current switching device Q2 to be turned on in response to a switching operation of the current switching device Q2, thereby applying a pre-charging current Ipre from the supply voltage source VDD to the current switching device Q2. Such a current supply TFT Q1 has a relatively larger W/L dimension ratio than the conversion TFT MT of the pixel 128. In this case, it is assumed that the current supply TFT Q1 should have a W/L dimension ratio that is 20 times larger than that of the conversion TFT MT. The second input terminal of the current switching device Q2 is connected to one end of the data line DL. Such a current switching device Q2 applies the pre-charging current-Ipre via the first current supply TFT Q1 to the data line DL in response to the pre-charging enable signal EN supplied from the timing controller 127.

Figure 8:
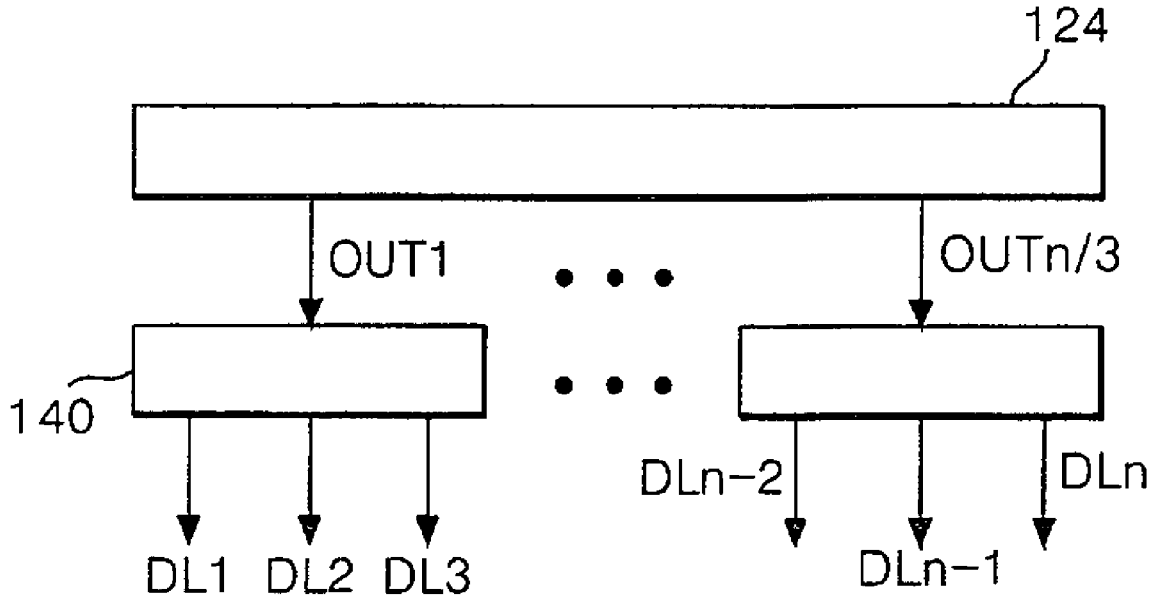
FIG. 8 is a block diagram of a current sample holder portion connected to the data driver shown in FIG. 4.

FIG. 8 is a block diagram of a current sample holder portion connected to the data driver shown in FIG. 4. As shown in FIG. 8, the current sample holder portion 140 is connected between one output line OUT of output lines OUT1 to OUTn/3 of the data driver 124 and three data lines DL3*n*, DL3*n*+1 and DL3*n*+2. Such a current sample holder portion 140 is connected to each of the output lines OUT1 to OUTn/3 of the data driver 124 and one side of the data line DL, thereby sampling an analog data signal applied to the pixels 128 for each one frame and sample an analog data signal at the (N+1) frame when an analog data signal is being applied to the pixels 128 at the N frame interval.

Figure 9:
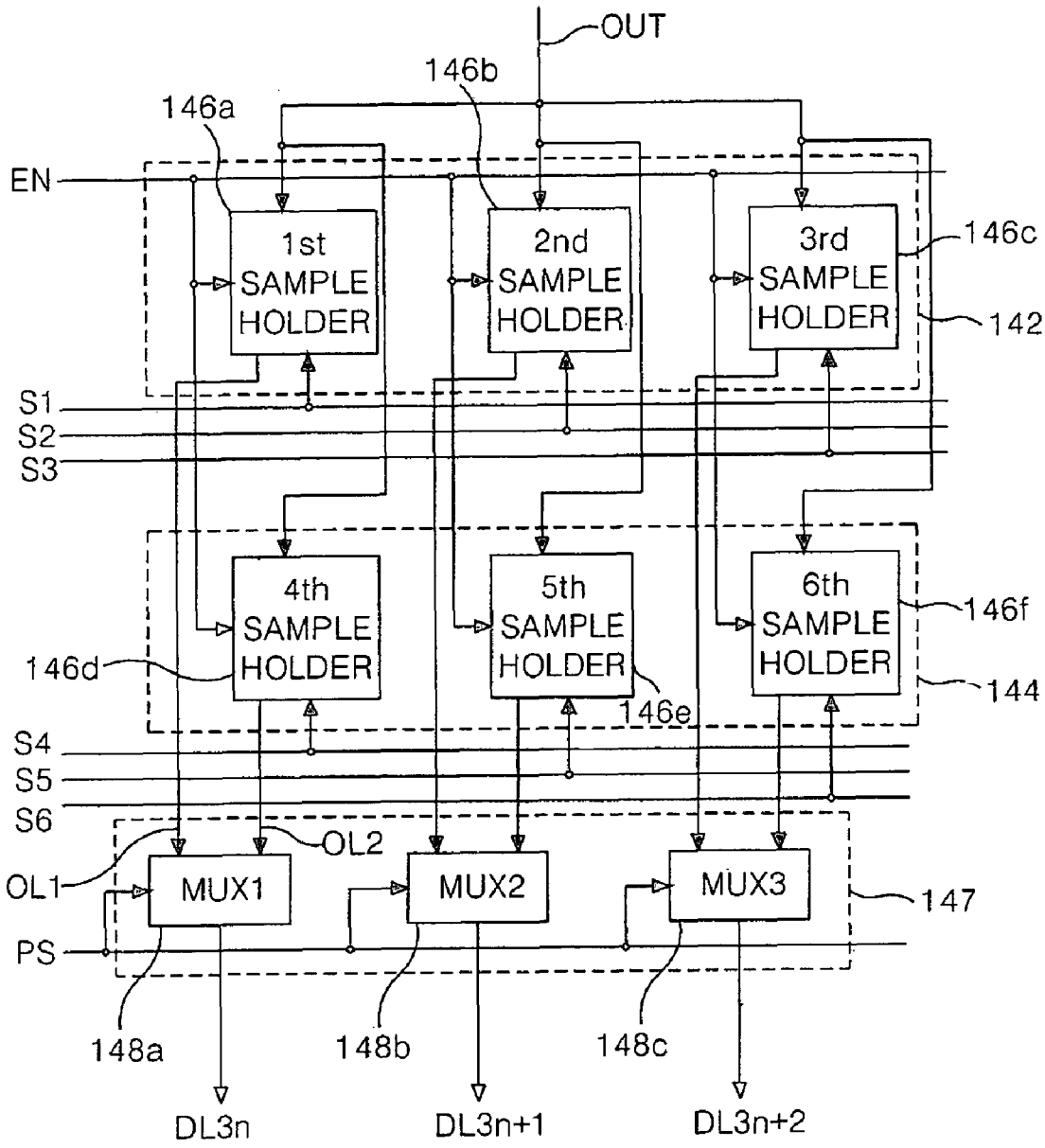
FIG. 9 is a block diagram of the current sample holder portion shown in FIG. 8.

FIG. 9 is a block diagram of the current sample holder portion shown in FIG. 8. As shown in FIG. 9, the current sample holder portion 140 includes a first sample holder portion 142 and a second sample holder portion between one output line OUT of the output lines OUT 1 to OUTn/3 of the data driver 124, and a multiplexor (MUX) array 147 connected to each output line OL1 and OL2 of the first and second sample holder portions 142 and 144 and three data lines DL3*n*, DL3*n*+1 and DL3*n*+2. The first sample holder portion 142 includes a first sample holder 146*a*, a second sample holder 146*b* and a third sample holder 146*c*. The first to third sample holders 146*a*, 146*b* and 146*c* are commonly supplied with the analog data signal from the data driver 124 and with the pre-charging enable signal EN from the timing controller 127. Further, the first sample holder 146*a* is supplied with a first selection signal S1; the second sample holder 146*b* is supplied with a second selection signal S2; and the third sample holder 146*c* is supplied with a third selection signal S3. Such a first sample holder portion 142 sequentially samples the analog data signal from the data driver 124 into the first sample holder 146*a*, the second sample holder 146*b* and the third sample holder 146*c* in respective correspondence with the first selection signal S1, the second selection signal S2 and the third selection signal in response to the pre-charging enable signal EN.

The second sample holder portion 144 includes a fourth sample holder 146*d*, a fifth sample holder 146*e* and a sixth sample holder 146*f*. The fourth to sixth sampled holders 146*d*, 146*e* and 146*f* are commonly supplied with the analog data signal from the data driver 124 and with the pre-charging enable signal EN from the timing controller 127. Further, the fourth sample holder 146*d* is supplied with a fourth selection signal S4; the fifth sample holder 146*e* is supplied with a fifth selection signal S5; and the sixth sample holder 146*f* is supplied with a sixth selection signal S6. Such a second sample holder portion 144 sequentially samples the analog data signal from the data driver 124 into the fourth sample holder 146*d*, the fifth sample holder 146*e* and the sixth sample holder 146*f* in respective correspondence with the fourth selection signal S4, the fifth selection signal S5 and the sixth selection signal S6 in response to the pre-charging enable signal EN. The first sample holder 146*a* and the fourth sample holder 146*d* are connected via a MUX array 147 to the same data line DL. The second sample holder 146*b* and the fifth sample holder 146*e* are connected via the MUX array 147 to the same data line; and the third and sixth sample holders 146*c* and 146*f* are connected via the MUX array 147 to the same data line DL.

The first to sixth sample holders 146*a* to 146*f* have the same configuration. Accordingly, the first to sixth sample holders 146*a* to 146*f* will be described in reference to the first sample holder 146*a* as an example.

Figure 10:
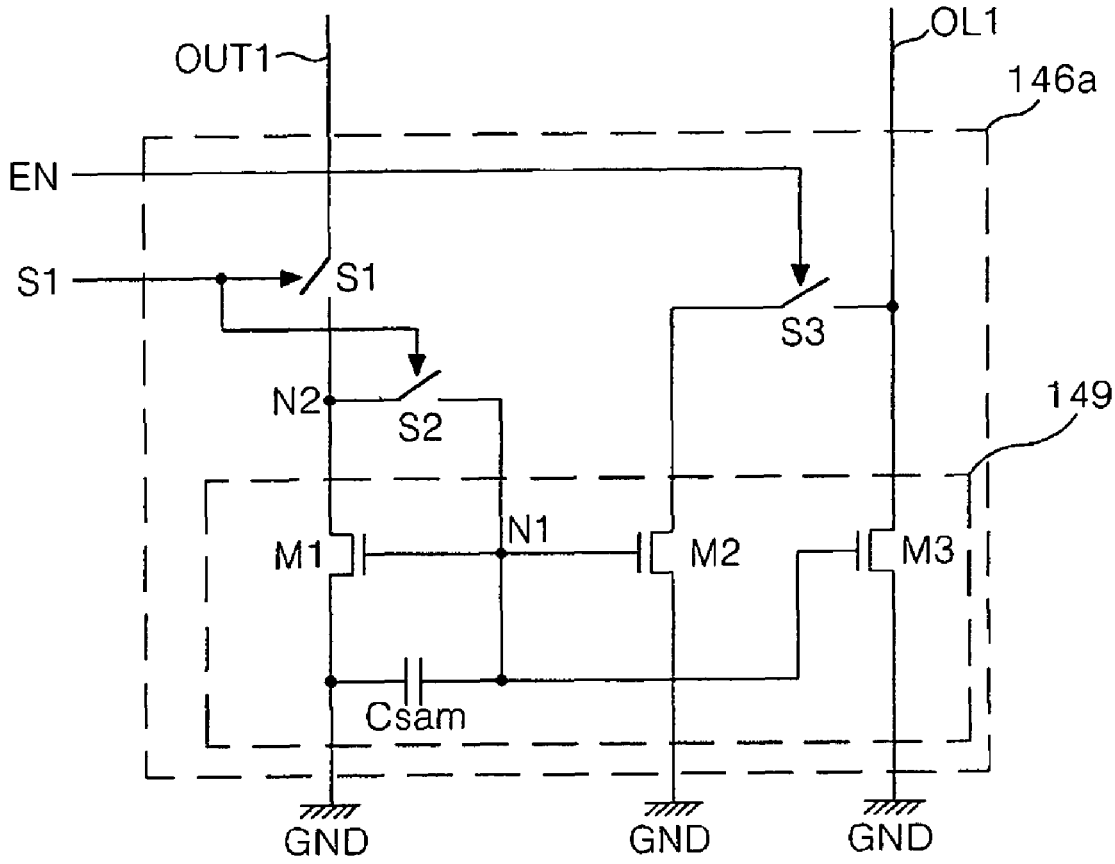
FIG. 10 is a circuit diagram of the sample holder shown in FIG. 9.

FIG. 10 is a circuit diagram of the sample holder shown in FIG. 9. As shown in FIG. 10, the first sample holder 146*a* includes a sampler 149 connected to the first output terminal OUT1 of the data driver 124, the ground voltage source GND and an output line OL1, a first selection switch S1 connected between the first output terminal OUT1 of the data driver 124 and the sampler 149, a second selection switch S2 connected between the first selection switch S1 and the sampler 149, and a third selection switch S3 connected between the output line OL1 and the sampler 149. The sampler 149 includes a first sampling TFT M1 connected between the first selection switch S1 and the ground voltage source GND, a second sampling TFT M2 connected between the first sampling TFT M1 and the third selection switch S3, a third sampling TFT M3 connected between a first node N1 to which gate terminals of the first sampling TFT M1 and second sampling TFT M2 are connected and the output line OL1 and the ground voltage source GND, and a sampling capacitor Csam connected between the first node N1 and the first sampling TFT M1.

The source terminal of the first sampling TFT M1 is connected to a second node N2 to which the first selection switch S1 and the second selection switch S2 are connected. The drain terminal of the second sampling TFT M2 is connected to the ground voltage source GND while the source terminal thereof is connected to the drain terminal of the third selection switch S3. The gate terminal of the third sampling TFT M3 is connected to the first node N1. The source terminal of the third sampling TFT M3 is connected to the output line OL1 and the drain terminal of the third sampling TFT M3 is connected to the ground voltage source GND. In this case, the first sampling TFT M1, the second sampling TFT M2 and the third sampling TFT M3 are provided adjacent to each other in such a manner to resemble a current mirror circuit. The first sampling TFT M1 and the third sampling TFT M3 form a current mirror circuit and have the same W/L dimension ratio while the second sampling TFT M2 has a relatively larger W/L dimension ratio than the first sampling TFT M1 and the third sampling TFT M3. The second sampling TFT M2 should have a W/L dimension ratio that is 20 times larger than the W/L dimension ratio of the first sampling TFT M1 or the third sampling TFT M3. Thus, the second sampling TFT M2 forms a first current path through which a relatively large current flows via the MUX array 147 between the data line DL and the ground voltage source GND in response to the pre-charging enable signal EN while the third sampling TFT M3 forms a second current path through which a relatively small current flows via the MUX array 147 between the data line DL and the ground voltage source GND in response to the pre-charging enable signal EN. At that time, a current flowing in the first current path is 20 times larger current than a current flowing in the second current path.

A sampling capacitor Csam is connected between the drain terminal and the gate terminal of the first sampling TFT M1 to store a voltage at the first node N1, and keeps ON states of the first to third sampling TFTs M1, M2 and M3 even though the first and second selection switches S1 and S2 are turned off with the aid of the stored voltage. The first input terminal of the first selection switch S1 is connected to the first output terminal OUT1 of the data driver 124 while the second input terminal thereof is connected to the second node N2. Such a first selection switch S1 applies an analog data signal from the first output terminal OUT1 of the data driver 124 to the second node N2 in response to a first selection signal S1 from the timing controller 127. The first input terminal of the second selection switch S2 is connected to the second node N2 while the second input terminal thereof is connected to the first node N1. Such a second selection switch S2 applies a voltage supplied via the first selection switch S1 to the second node N2 in response to the first selection signal S1 from the timing controller 127. In other words, the second selection switch S2 applies a voltage at the second node N2 to the gate terminal of each of the first sampling TFT M1 and second sampling TFT M2 are connected to the first node N1. The first input terminal of the third selection switch S3 is connected to the output line OL1 while the second input terminal thereof is connected to the source terminal of the second sampling TFT M2. Such a third selection switch S3 applies a pre-charging current Ipre fed to the output line OL1 to the source terminal of the second sampling TFT M2 in response to the pre-charging enable signal EN from the timing controller 127.

The MUX array 147 includes a first MUX 148*a* connected to each output line OL1 and OL2 of the first sample holder 146*a* and fourth sample holder 146*d* and the (3*n*)th data line DL3*n*. A second MUX 148*b* connected to each output line OL1 and OL2 of the second and fifth sample holders 146*b* and 1146*e* and the (3*n*+1)th data line DL3*n*+1. A third MUX 148*c* connected to each output line OL1 and OL2 of the third and sixth sample holders 146*c* and 146*f* and the (3*n*+2)th data line DL3*n*+2. The first MUX 148*a* selectively connects each output line OL1 and OL2 of the first and fourth sample holders 146*a* and 146*d* to the (3*n*)th data line DL3*n* in response to a pre-charging selection signal PS from the timing controller 127. The second MUX 148*b* selectively connects each output line OL1 and OL2 of the second and fifth sample holders 146*b* and 146*e* to the (3*n*+1)th data line DL3*n*+1 in response to the pre-charging selection signal PS from the timing controller 127. The third MUX 148*c* selectively connects each output line OL1 and OL2 of the third and sixth sample holders 146*c* and 146*f* to the (3*n*+2)th data line DL3*n*+2 in response to the pre-charging selection signal PS from the timing controller 127.

Figure 11:
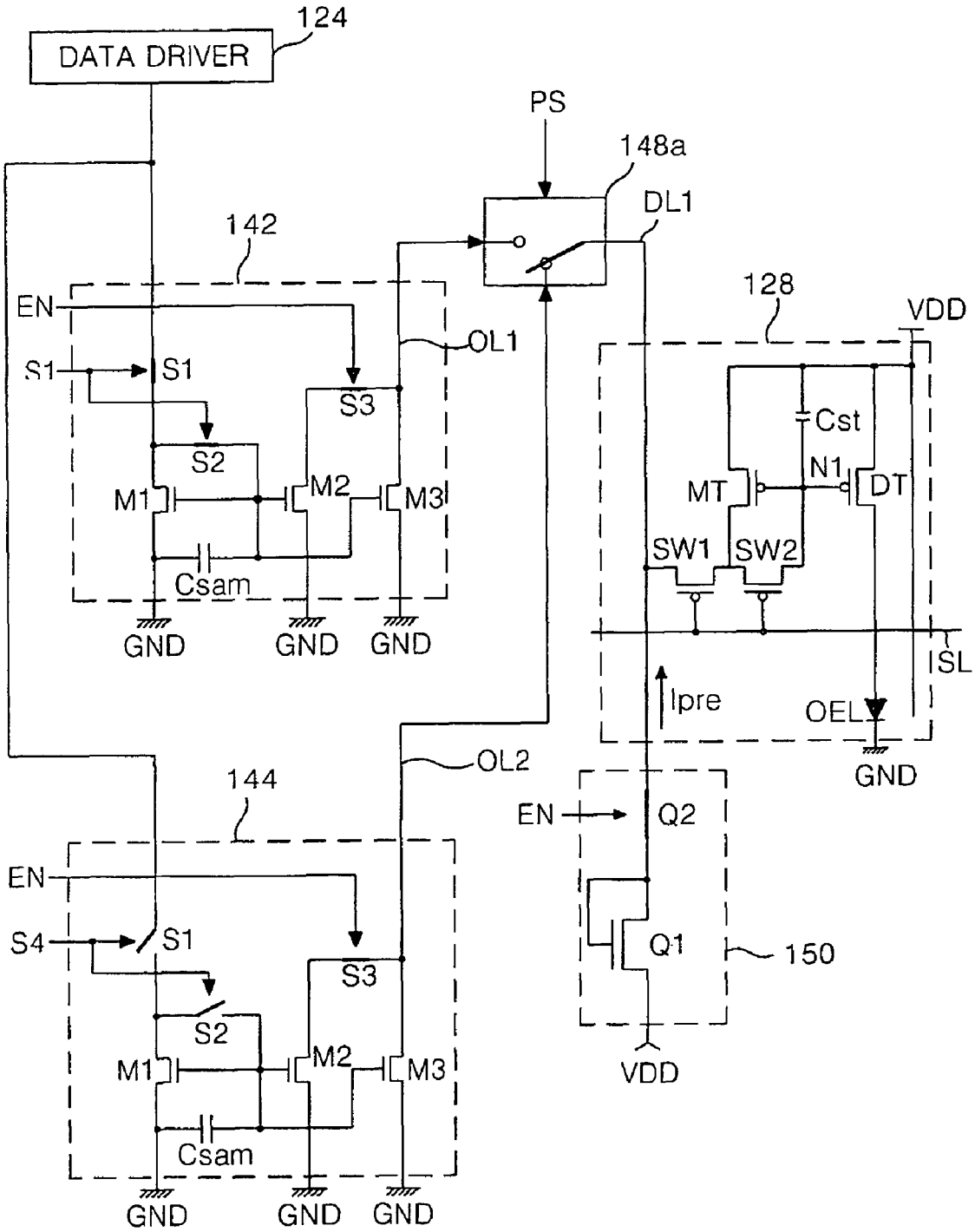
FIG. 11 illustrates a driving state of the switching devices according to driving signals applied in the T1 interval shown in FIG. 5.

FIG. 11 illustrates a driving state of the switching devices according to driving signals applied in the T1 interval shown in FIG. 5. The EL display device and the driving method thereof according to the present invention will be described in conjunction with FIG. 5 and FIG. 11 below. Only the driving of one pixel 128 of a plurality of pixels, will be described as an example for the sake of convenience.

A data signal from the data driver 124 has been stored in the sampling capacitor Csam of the fourth sample holder 146*d* in a time interval prior to the T1 interval as shown in FIG. 5. In the T1 interval when a scanning pulse SP at an ON state is applied to the Nth scan line SLn, a pre-charging enable signal EN having a width equal to a quarter (¼) of the width of the scanning pulse SP and a pre-charging selection signal PS at a low state are supplied, and the first to third selection signals S1, S2 and S3 at an ON state and the fourth to sixth selection S4, S5 and S6 at an OFF state are sequentially supplied. Accordingly, the first MUX 148*a* connects the first data line DL1 to the output line OL2 of the fourth sample holder 146*d* in response to the pre-charging selection signal PS as shown in FIG. 11. The first selection switch S1 and the second selection switch S2 of the fourth sample holder 146*d* connected to the first data line DL1 by the first MUX 148*a* are turned off with the aid of the fourth selection signal S4 at an OFF state. At the same time, the third selection switch S3 of the fourth sample holder 146*d* and the current switching device Q2 of the pre-charging current supplier 150 are turned on with the aid of the pre-charging enable signal EN at an ON state. Thus, the output line OL2 of the fourth sample holder 146*d* is connected to the first data line DL1 by the first MUX 148*a* in such a state that the first to third sampling TFTs M1, M2 and M3 remain at an ON state with the aid of a data signal stored in the sampling capacitor Csam of the fourth sample holder 146*d*, thereby coupling a potential on the first data line DL1 with the ground voltage source GND. At this time, if the scanning pulse SP at an ON state is applied to the Nth scan line SLn, the first switching TFT SW1 and the second switching TFT SW2 of the light-emitting cell driving circuit 128 are turned on.

As the first switching TFT SW1 and the second switching TFT SW2 are turned on, the driving TFT DT and the conversion TFT MT are turned on. Accordingly, the driving TFT DT applies a current from the supply voltage source VDD to the light-emitting cell OEL to thereby radiate the light-emitting cell OEL. At the same time, a large current is applied from the pre-charging current suppler 150 via the current supply TFT Q1 and the current switching device Q2 to the first data line DL1. At this time, a current flows through the driving TFT DT and a current Ipre flowing from the pre-charging current supplier 150 into the first data line DL1 is twenty times greater than the current flowing through the driving TFT DT. In other words, the second sampling TFT M2 and third sampling TFT M3 of the fourth sample holder 146*d* are turned on with the aid of a data voltage stored in the sampling capacitor Csam to sink the current Ipre on the first data line DL1 via the first MUX 148*a* into the ground voltage source GND, thereby allowing the current on the first data line DL1 to be twenty times greater than the current flowing through the driving TFT DT in accordance with the larger W/L dimension ratio of the second sampling TFT M2 in comparison to the third sampling TFT M3.

As mentioned above, in the T1 interval when the scanning pulse SP at an ON state is applied to the Nth scan line SLn, a magnitude of a driving current supplied to the first data line DL1 and the light-emitting cell OEL of the pixel 128 is temporarily increased largely with the aid of the pre-charging current supplier 150 and the fourth sample holder 146*d* in a time interval at which the pre-charging enable signal EN is applied. Accordingly, the EL display device and the driving method thereof according to the embodiment of the present invention temporarily increases a driving current for the pixel 128 so that it can solve a charge and discharge problem in the storage capacitor Cst and the data line DL of the pixel 128 caused by a low driving current. Meanwhile, as described above, in the T1 interval when the scanning pulse SP at an ON state is applied to the Nth scan line SLn, a current corresponding to the data signal stored in the storage capacitor Cst is applied from the supply voltage source VDD to the light-emitting cell OEL owing to the pre-charging enable signal EN at an OFF state after a time interval at which the pre-charging enable signal EN is applied.

The first sample holder 146*a* samples a data signal from the data driver 124 and stores it when a driving current is being applied to the pixel 128 with the aid of the fourth sample holder 146*d*. More specifically, the first selection switch S1 and the second selection switch S2 of the first sample holder 146*a* are turned on with the aid of the first selection signal S1 while the third selection switch S3 is turned on with the aid of the pre-charging enable signal EN. Thus, the first sample holder 146*a* stores an analog data signal from the data driver 124 into the sampling capacitor Csam by a turning-on of the first switch S1, a second switch S2 and a third switch S3. At this time, the output line OL1 of the first sample holder 146*a* is in a state being not connected to the first data line DL1 with the aid of the first MUX 148*a*.

Figure 12:
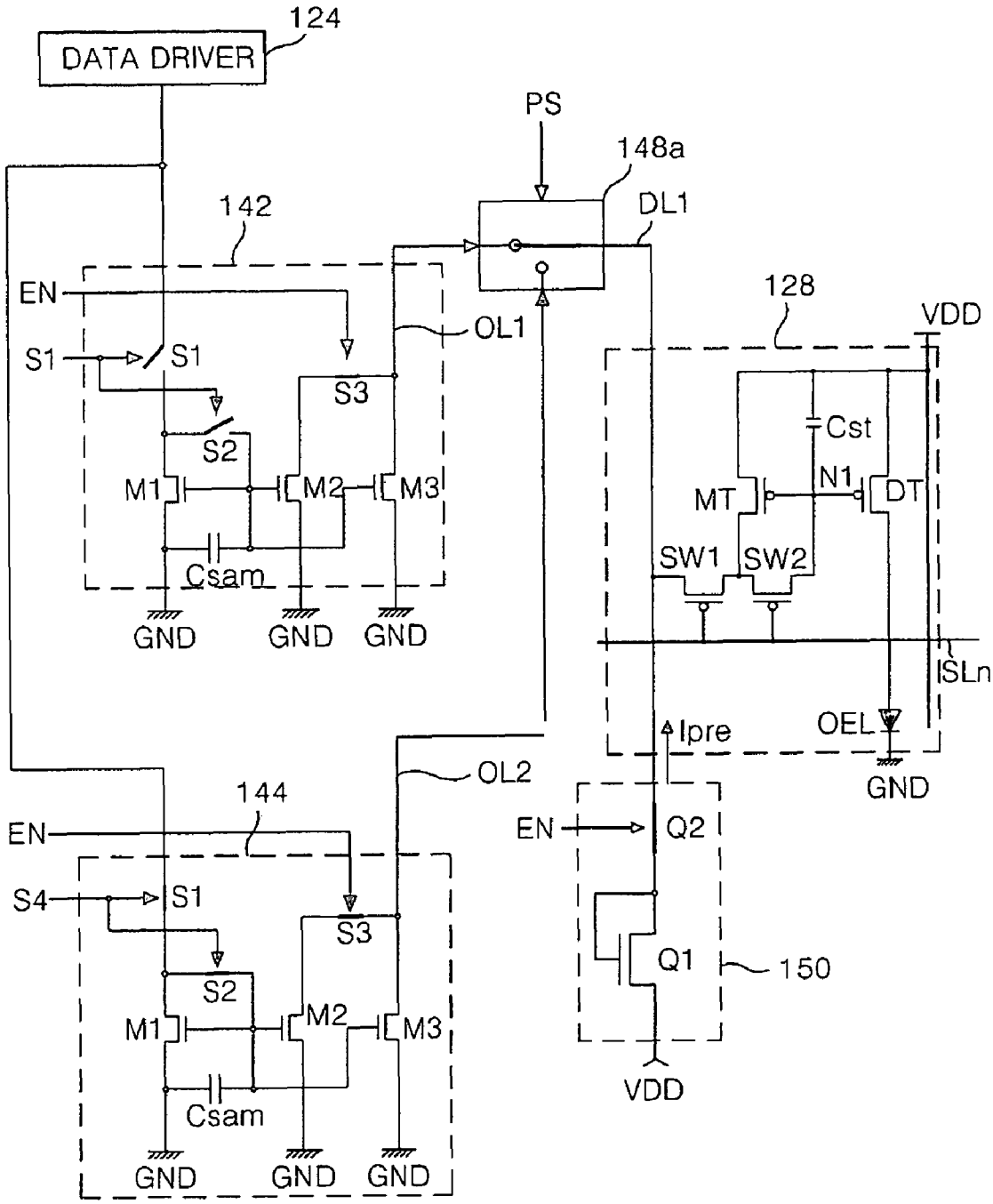
FIG. 12 illustrates a driving state of the switching devices according to driving signals applied in the T1 interval shown in FIG. 5.

In the T2 interval, when a scanning pulse SP at an ON state is applied to the (N+1)th scan line SLn+1, a pre-charging enable signal EN having a width equal to a quarter (¼) of the width of the scanning pulse SP and a pre-charging selection signal PS at a high state are supplied, and the fourth to sixth selection signals S4, S5 and S6 at an ON state and the fourth to sixth selection S4, S5 and S6 at an ON state are sequentially supplied. Accordingly, the first MUX 148*a* connects the first data line DL1 to the output line OL1 of the first sample holder 146*a* in response to the pre-charging selection signal PS, as shown in FIG. 12. The first selection switch S1 and the second selection switch S2 of the first sample holder 146*a* connected to the first data line DL1 by the first MUX 148*a* are turned off with the aid of the fourth selection signal S4 at an OFF state. At the same time, the first selection switch S1 of the first sample holder 146*a* and the current switching device Q2 of the pre-charging current supplier 150 are turned on with the aid of the pre-charging enable signal EN at an ON state. Thus, the output line OL1 of the first sample holder 146*a* is connected to the first data line DL1 by the first MUX 148*a* in such an state that the first sampling TFT M1, the second sampling TFT M2 and the third sampling TFT M3 remain at an ON state with the aid of a data signal stored in the sampling capacitor Csam of the first sample holder 146*a*, thereby coupling a potential on the first data line DL1 with the ground voltage source GND. At this time, if the scanning pulse SP at an ON state is applied to the (N+1)th scan line SLn+1, then the first switching TFT SW1 and second switching TFT SW2 of the light-emitting cell driving circuit 130 are turned on.

As the first switching TFT SW1 and the second switching TFT SW2 are turned on, the driving TFT DT and the conversion TFT MT are turned on. Accordingly, the driving TFT DT applies a current from the supply voltage source VDD to the light-emitting cell OEL to thereby radiate the light-emitting cell OEL. At the same time, a large current is applied from the pre-charging current suppler 150 via the current supply TFT Q1 and the current switching device Q2 to the first data line DL1. At this time, a current flows through the driving TFT DT and a current Ipre flowing from the pre-charging current supplier 150 into the first data line DL1 is twenty times greater than the current flowing through the driving TFT DT. In other words, the second sampling TFT M2 and third sampling TFT M3 of the first sample holder 146*a* is turned on with the aid of a data voltage stored in the sampling capacitor Csam to sink the current Ipre on the first data line DL1 via the first MUX 148*a* into the ground voltage source GND, thereby allowing the current on the first data line DL1 to be twenty times greater than the current flowing through the driving TFT DT in accordance with the larger W/L dimension ratio of the second sampling TFT M2 in comparison to the third sampling TFT M3.

As mentioned above, in the T2 interval when the scanning pulse SP at an ON state is applied to the (N+1)th scan line SLn+1, a magnitude of a driving current supplied to the first data line DL1 and the light-emitting cell OEL of the pixel 128 is temporarily increased largely with the aid of the pre-charging current supplier 150 and the fourth sample holder 146*d* in a time interval at which the pre-charging enable signal EN is applied. Accordingly, the EL display device and the driving method thereof according to the embodiment of the present invention temporarily increases a driving current for the pixel 128 so that it can solve a charge and discharge problem in the storage capacitor Cst and the data line DL of the pixel 128 caused by a low driving current. Meanwhile, as described above, in the T2 interval when the scanning pulse SP at an ON state is applied to the (N+1)th scan line SLn+1, a current corresponding to the data signal stored in the storage capacitor Cst is applied from the supply voltage source VDD to the light-emitting cell OEL owing to the pre-charging enable signal EN at an OFF state after a time interval at which the pre-charging enable signal EN is applied.

The fourth sample holder 146*d* samples a data signal from the data driver 124 and stores it when a driving current is being applied to the pixel 128 with the aid of the first sample holder 146*a*. More specifically, the first selection switch S1 and second selection switch S2 of the fourth sample holder 146*d* are turned on with the aid of the fourth selection signal S4 while the third selection switch S3 is turned on with the aid of the pre-charging enable signal EN. Thus, the fourth sample holder 146*d* stores an analog data signal from the data driver 124 into the sampling capacitor Csam by a turning-on of the first to third switches S1, S2 and S3. At this time, the output line OL2 of the first sample holder 146*d* is in a state being not connected to the first data line DL1 with the aid of the first MUX 148*a*. The EL display device and the driving method thereof according to the present invention repeat the above-mentioned T1 interval and T2 interval, thereby driving the pixels 128.

The EL display device and the driving method thereof according to the embodiment of the present invention may use only the current sample holder portion 140 built-in with a current amplifying circuit that amplifies a current without the pre-charging current supplier 150. Alternatively, The EL display device and the driving method thereof according to the embodiment of the present invention may change a type (i.e., N-type or P-type) of the switching devices such that they are applicable to a current-driving EL display device, that is, a current-sink type or current-source type EL display device.

Figure 13:
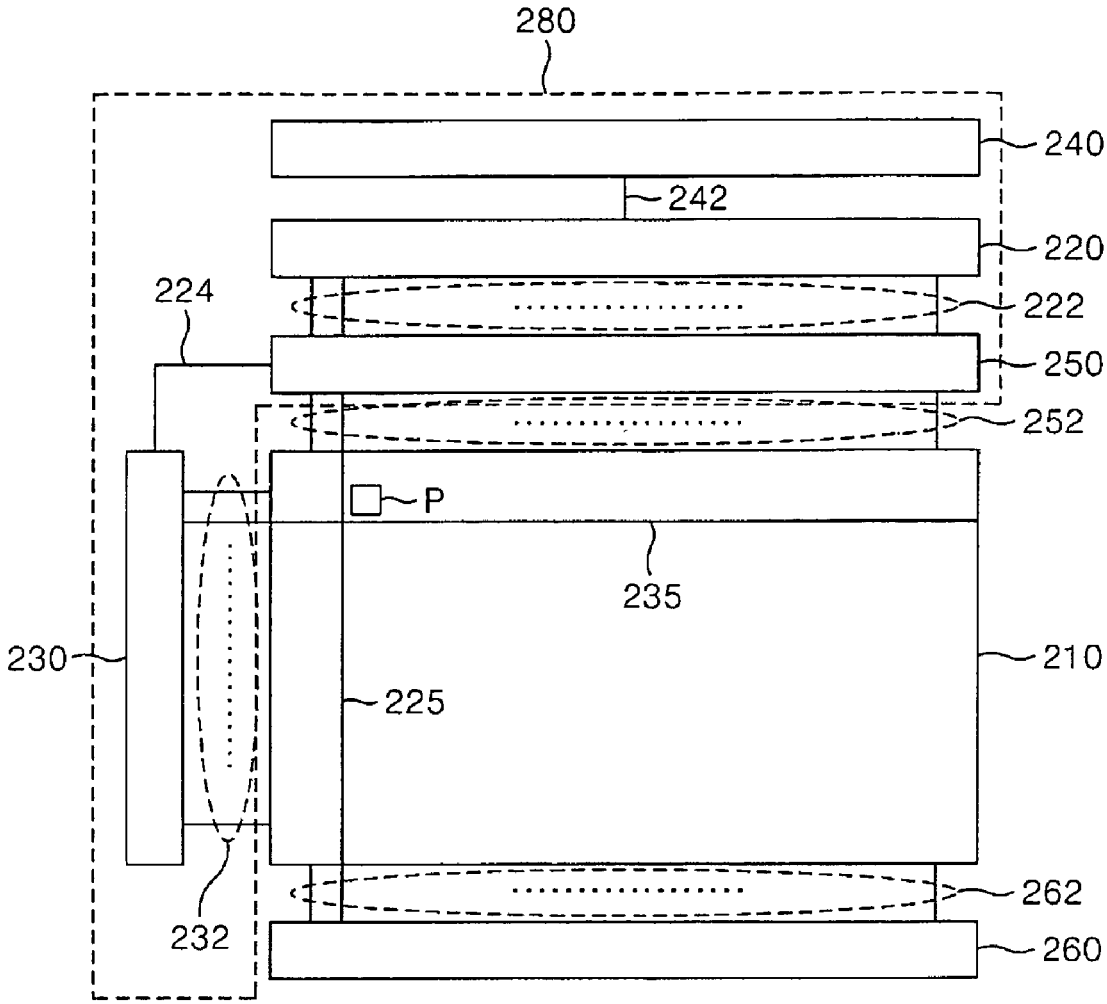
FIG. 13 illustrates a schematic configuration of an electro-luminescence display device according to a second embodiment of the present invention.

FIG. 13 is a block diagram showing a configuration of an EL display device according to a second embodiment of the present invention. As shown in FIG. 13, the EL display device according to the second embodiment of the present invention includes an EL panel 210, and a driving circuit 280 provided with a pre-charger 250, a current amplifier 260, a data driver 220, a scan driver 230 and a controller 240. The EL panel 210 has a plurality of pixels P arranged in a matrix. Each pixel is adjacent to where one of the data lines 225 and one of the scan lines 235 cross. In addition, each pixel is provided with two switching thin film transistors, two driving thin film transistors and light-emitting cells connected to the driving thin film transistors (not shown).

A pre-charger 250 and the current amplifier 260 are connected via a first connecting line 252 and a second connecting line 262, respectively, to the EL panel 210. The first connecting lines 252 and second connecting lines 262 are connected to the data lines 225 and the scan lines 235 of the EL panel 210, respectively. A data driver 220 is connected via third connecting lines 222 to the pre-charger 250. The scan driver 230 is connected via fourth connecting lines 232, to the EL panel 210. A controller 240 is connected via a fifth connecting line 242 to the data driver 220. The pre-charger 250 is connected via a sixth connecting line 224 to the scan driver 230.

If various signals required for a display are generated from the controller 240 and are delivered into the data driver 220, then the data driver 220 applies a portion of the delivered signals via the third connecting lines 222 to the pre-charger 250 and the remaining portion of the delivered signals via the sixth connecting line 224 to the scan driver 230. The scan driver 230 sequentially applies a signal to the second connecting line 232 with the aid of the applied signals. As each of the second connecting line 232 is connected to the gate electrode of the switching thin film transistor (not shown) of the EL panel 210, the switching thin film transistor is turned on when a signal is applied to the second connecting line 232. At this time, the data driver 220 applies a data signal to be displayed to the source electrode of the switching thin film transistor to thereby drive the light-emitting cell (not shown).

Unlike the related art EL display device, the EL display device according to the second embodiment of the present invention, the pre-charger 250 and the current amplifier 260 amplifies a current value of a desired signal output from the driving circuit 280 and inputs it to the data line 225 of the EL panel 210 during a pre-charging period prior to a time when the data signal begins to be input to the switching thin film transistor, thereby allowing the data line 225 to have a value close to a desired voltage.

The data line 225 has already arrived at a value close to a desired voltage prior to a time when the data signal is input to the data line 225 so that it becomes possible to shorten a time when a data signal output from the data driver 220 after the pre-charging period is delivered via the data line 225 into the driving thin film transistor (not shown). Alternatively, even when the current amplifier only is used without the above-mentioned pre-charger, the amplified current flows into the data line prior to an input of the data signal to thereby allow the data line to have a value close to a desired voltage so that it becomes possible to shorten a time when the data signal is delivered into the driving thin film transistor.

Figure 14:
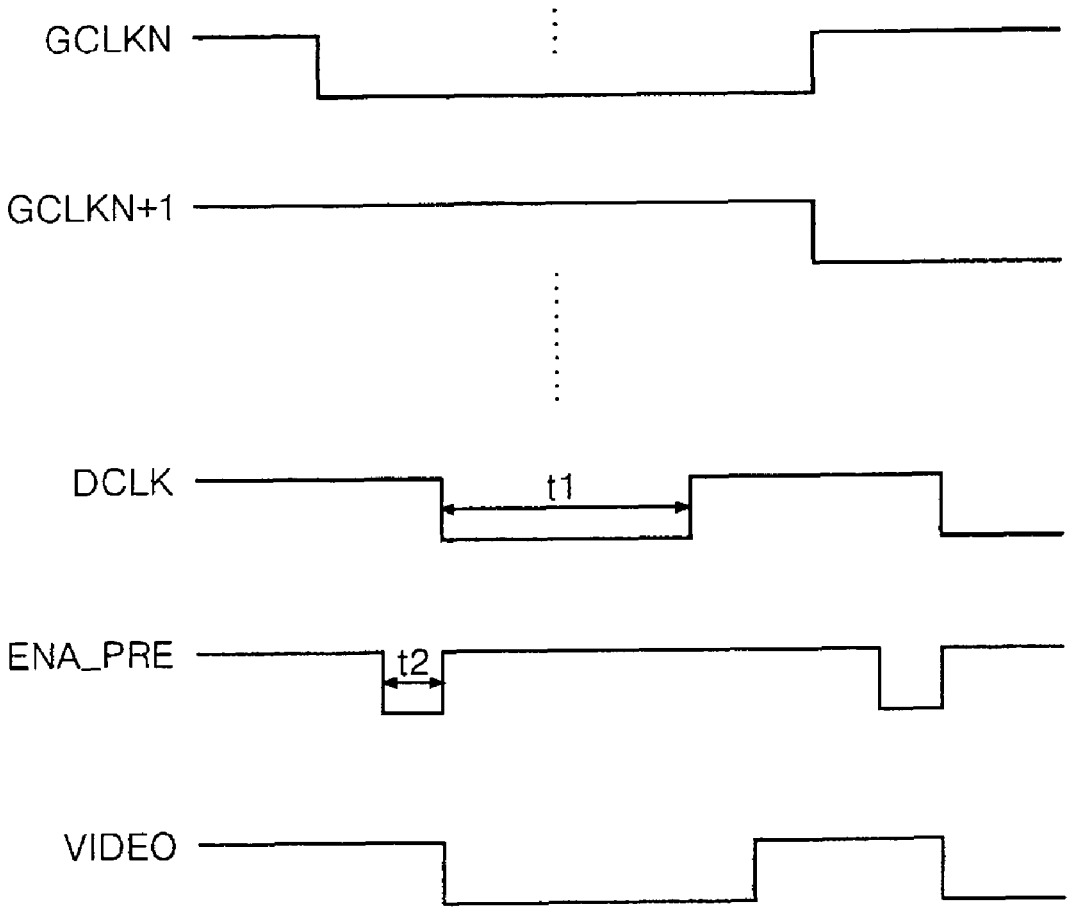
FIG. 14 is a timing diagram of driving signals for the electro-luminescence display device according to the second embodiment of the present invention.

FIG. 14 is a timing diagram of driving signals for an EL display device according to a third embodiment of the present invention. As shown in FIG. 14, a gate signal is sequentially input to the Nth scan line and the (N+1)th scan line of the EL panel 210 in response to a Nth scan clock GCLKN and a (N+1)th scan clock GCLKN+1. Thus, the switching thin film transistor connected to the Nth scan line and the switching thin film transistor connected to the (N+1)th scan line are sequentially turned on. If the Nth scan line is selected, then a data signal VIDEO is input, via the data line 225, to the switching thin film transistor during a first time interval t1 in response to a data clock DCLK.

In the third embodiment of the present invention, a certain period prior to the first interval t1 is set to a pre-charging interval t2. The pre-charger 250 and the current amplifier 260 are operated in response to a pre-charging signal ENA_PRE, thereby inputting the amplified current to the data line 225. Accordingly, the data line 225 has already arrived at a value close to a desired voltage with the aid of a high current during the pre-charging interval t2 prior to the first interval t1 when the data signal VIDEO is input. Thus, it is possible to shorten a time required for allowing the data signal VIDEO to turn on/off the driving thin film transistor during a pre-determined time at an initial time of the first interval t1 when the data signal VIDEO is input, thereby displaying a desired picture at an appropriate time.

Figure 15:
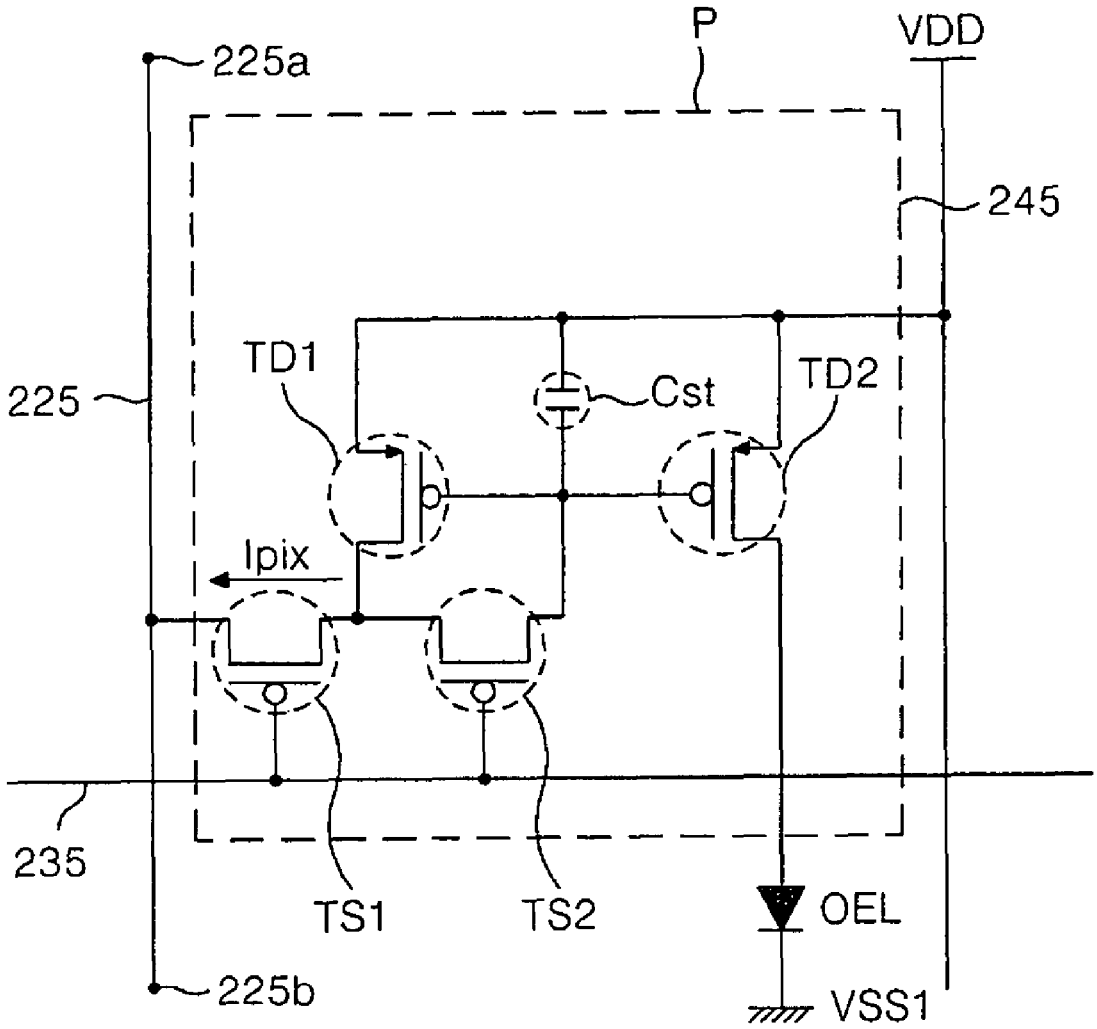
FIG. 15 is a circuit diagram of pixels of an electro-luminescence panel connected to one data line in an electro-luminescence display device according to a third embodiment of the present invention.
Figure 16:
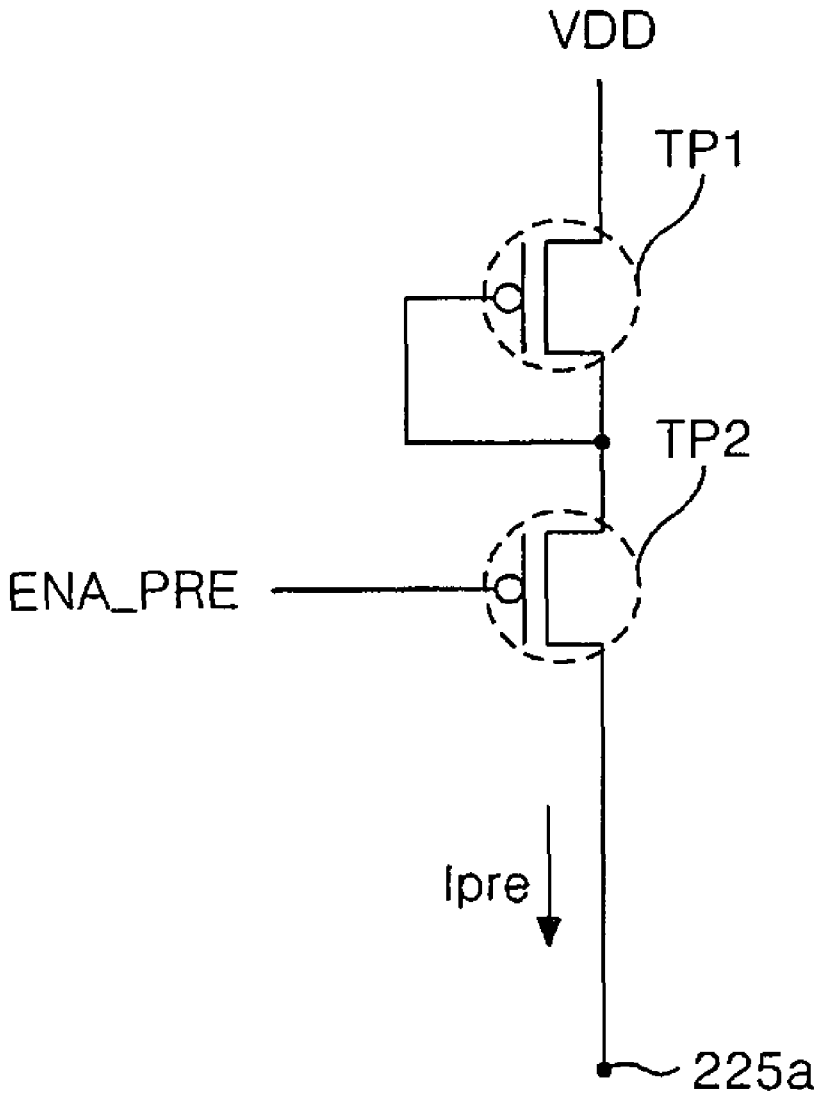
FIG. 16 is a circuit diagram of the pre-charger connected to one data line in the electro-luminescence display device according to the third embodiment of the present invention.
Figure 17:
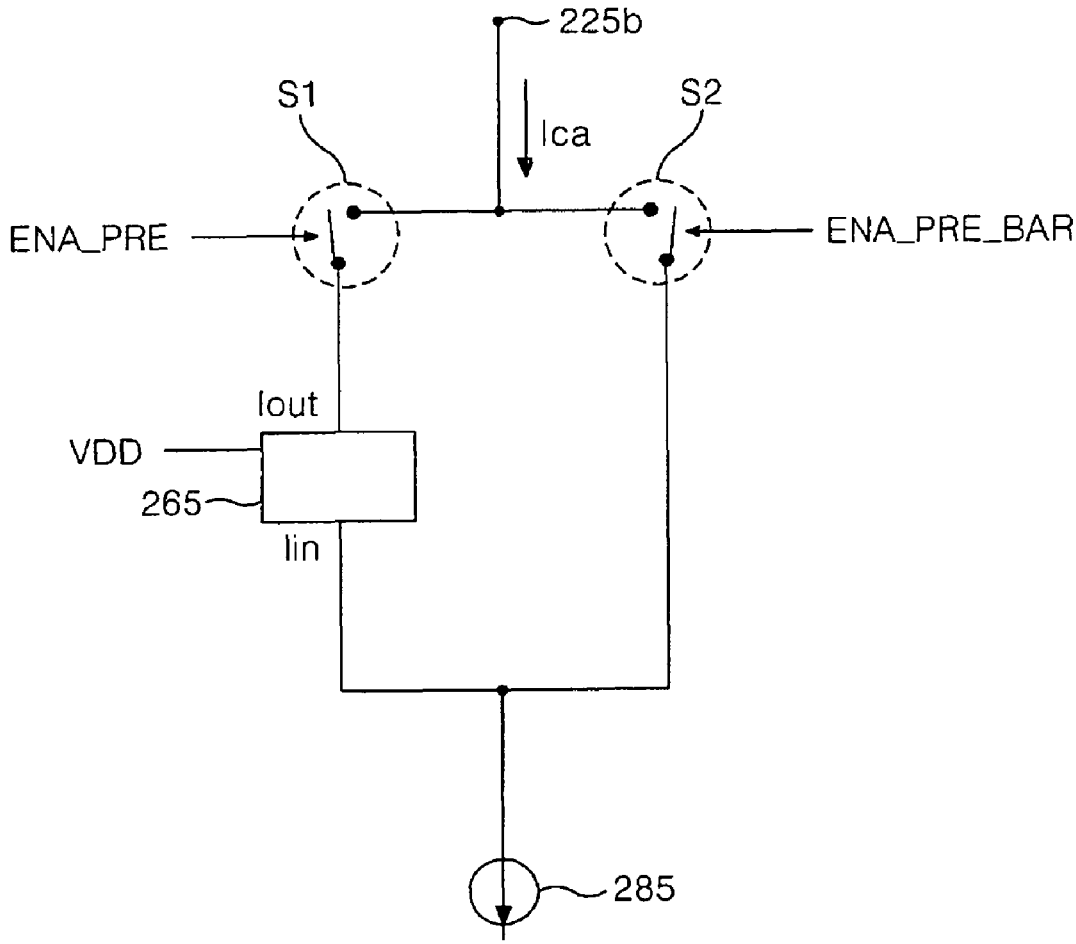
FIG. 17 is a circuit diagram of a current amplifier connected to one data line in an electro-luminescence display device according to a fourth embodiment of the present invention.
Figure 18:
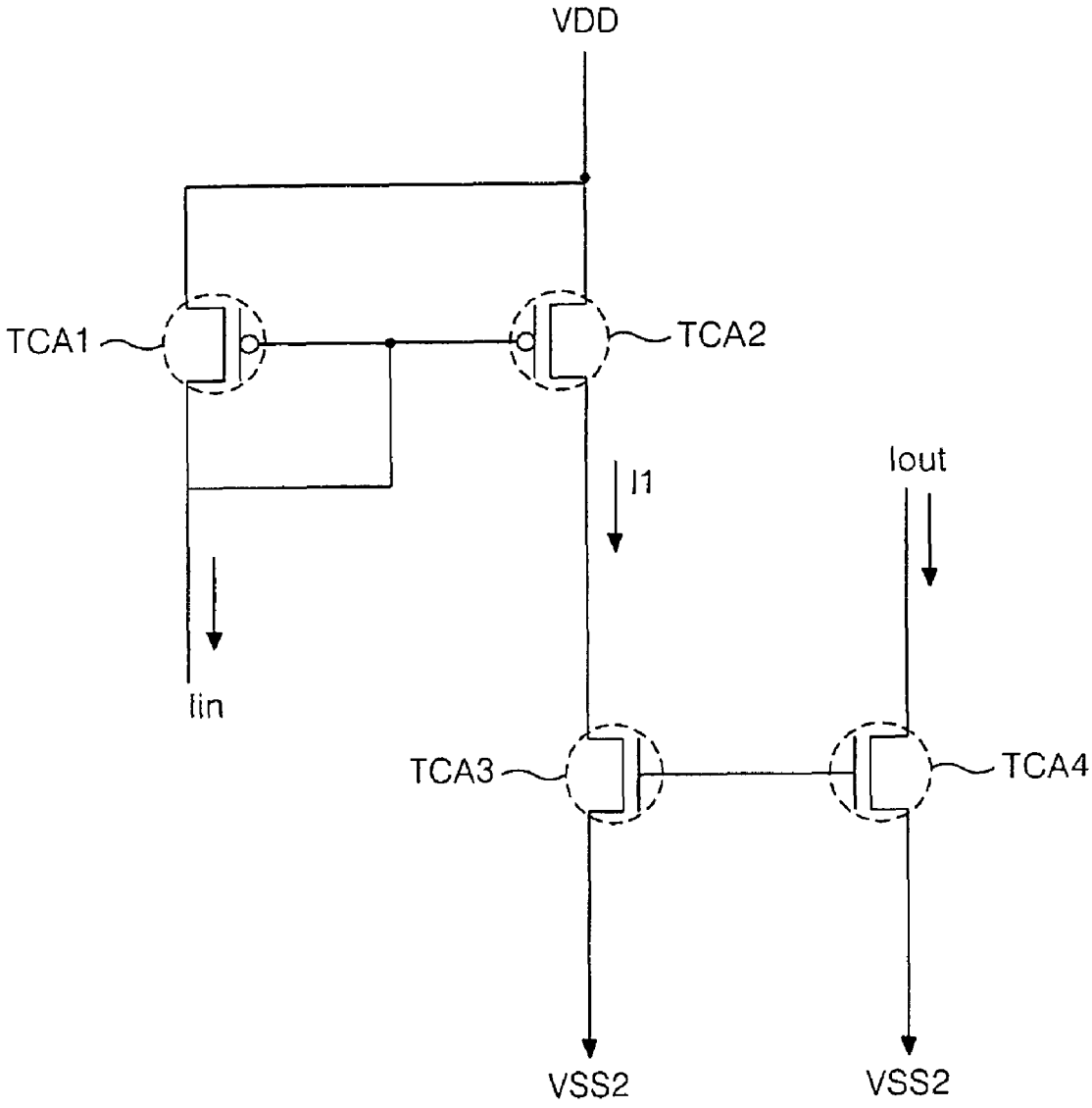
FIG. 18 is a detailed circuit diagram of the current amplifier shown in FIG. 17.

FIG. 15, FIG. 16 and FIG. 17 are respective circuit diagrams of pixels, a pre-charger and a current amplifier connected to one data line in an EL display device according to a fourth embodiment of the present invention. FIG. 18 is a detailed circuit diagram of the current amplifier shown in FIG. 17. As shown in FIG. 15, each pixel P defined by a data line 225 and a scan line 235 is provided with first witching thin film transistor TS1, a second switching thin film transistors TS2, first driving TFT TD1, second driving TFT TD2, a storage capacitor Cst and a light-emitting cell OEL. More specifically, the first switching TFT TS1 and the second switching TFT TS2 are connected in series to the data line 225. The gate electrodes of the first switching TFT TS1 and second switching thin film TFT TS2 are connected to the scan line 235. Gate electrodes of the first driving TFT TD1 and the second driving TFT TD2 are connected to one electrode of the storage capacitor Cst while the other electrode of the storage capacitor Cst is connected to a power line 245. The second driving TFT TD2 is connected to the light-emitting cell OEL to control a current application from the power line 245, thereby implementing a picture. The first switching TFT TS 1, the second switching TFT TS2, the first driving TFT TD1 and the second driving TFT TD2 are p-type transistors.

If the scan line 235 is selected to turn on the first switching TFT TS1 and second switching TFT TS2, then a data signal is input to the data line 225 and is charged in the gate electrodes of the first driving TFT TD1 and the second driving TFT TD2 and one electrode of the storage capacitor Cst. The second driving TFT TD2 can control an amount of a current from the power line 245 because an amount of an ON current is differentiated in accordance with the charged data signal.

A first terminal 225*a* of the data line 225 is connected with the pre-charger shown in FIG. 16 while a second terminal 225*b* thereof is connected with the current amplifier shown in FIG. 17. The pre-charger shown in FIG. 16 is comprised of a first p-type pre-charging transistor TP1 and a second p-type pre-charging transistor TP2 connected in series to the high voltage source VDD. A pre-charging signal ENA_PRE is input to the gate electrode of the second pre-charging transistor TP2, thereby applying a pre-charging current Ipre to the data line 225 during the pre-charging interval t2. The first pre-charging transistor TP1 and the second pre-charging transistor TP2 can be manufactured to have a large W/L dimension ratio such that several to tens of times larger current than a current output from an integrated circuit of the driving circuitry can flow in the first pre-charging transistor TP1 and the second pre-charging transistor TP2.

The current amplifier shown in FIG. 17 is comprised of a current amplifying unit 265, a first switch S1, a second switch S2 and a current source 285. The first switch S1 is switched in response to the pre-charging signal ENA_PRE while the second switch S2 is switched in response to an inverted pre-charging signal ENA_PRE_BAR having a polarity contrary to the pre-charging signal ENA_PRE. Thus, an amplifying current Ica flows through the current amplifying unit 265 during the pre-charging interval t2 while it flows not through the current amplifying unit 265 during the first interval t1. The current amplifying unit 265 is connected to the external high voltage source VDD to amplify an input current Iin and send an output current Iout. The current source 285 is an integrated circuit (IC) of the driving circuit 280, which plays a role in applying a current to the current amplifier. The amplifying current Ica flowing in the current amplifier becomes several to tens of times larger current than a current output from the IC of the driving circuit when the pre-charging signal ENA_PRE is turned into an ON signal. In this case, a pixel current Ipix flowing in the first switching TFT TS1 of the pixel P and a pre-charging current Ipre at the pre-charger have a relationship of Ipre+Ipix=Ica or Ipre=Ica.

FIG. 18 is a circuit diagram of an example of the current amplifier shown in FIG. 17. As shown in FIG. 18, the current amplifying unit 265 is comprised of a first amplifying transistor TCA1, a second amplifying transistor TCA2, a third amplifying transistor TCA3 and a fourth amplifying transistor TCA4. The first amplifying transistor TCA1 and second amplifying transistor TCA2 can be p-type transistors while the third amplifying transistor TCA3 and the fourth amplifying transistor TCA4 are n-type transistors. The first amplifying transistor TCA1 and second amplifying transistor TCA2 have gate electrodes connected to each other and are connected in parallel to the high voltage source VDD. The third amplifying transistor TCA3 is connected in series to the second amplifying transistor TCA2. The gate electrodes of the third amplifying transistor TCA3 and the fourth amplifying transistor TCA4 are connected to each other. Since the current amplifying unit 265 amplifies an input current Iin to send an output current Iout, W/L ratios of the first to fourth amplifying transistors TCA1 to TCA4 are set such that a current I1 flowing in the second amplifying transistor TCA2 has a relationship of Tin≦I1≦Iout with respect to the input current Iin and the output current Iout.

As described above, the EL display device according to the fourth embodiment of the present invention allows several to tens of times larger current than a current output from the IC of the driving circuit to flow into the data line during a certain period (i.e., the pre-charging interval t2) prior to a time when the data signal is input with the aid of the pre-charger and the current amplifier, thereby making a potential on the data line into a value close to a desired voltage. Accordingly, the time when the data signal is charged thereafter is shorter. Further, even if the current amplifier is used without the above-mentioned pre-charger, the amplified current flows into the data line prior to an input of the data signal, thereby allowing the data line to have a value close to a desired voltage so that the time for delivering the data signal into the driving thin film transistor can be shortened.

Figure 19:
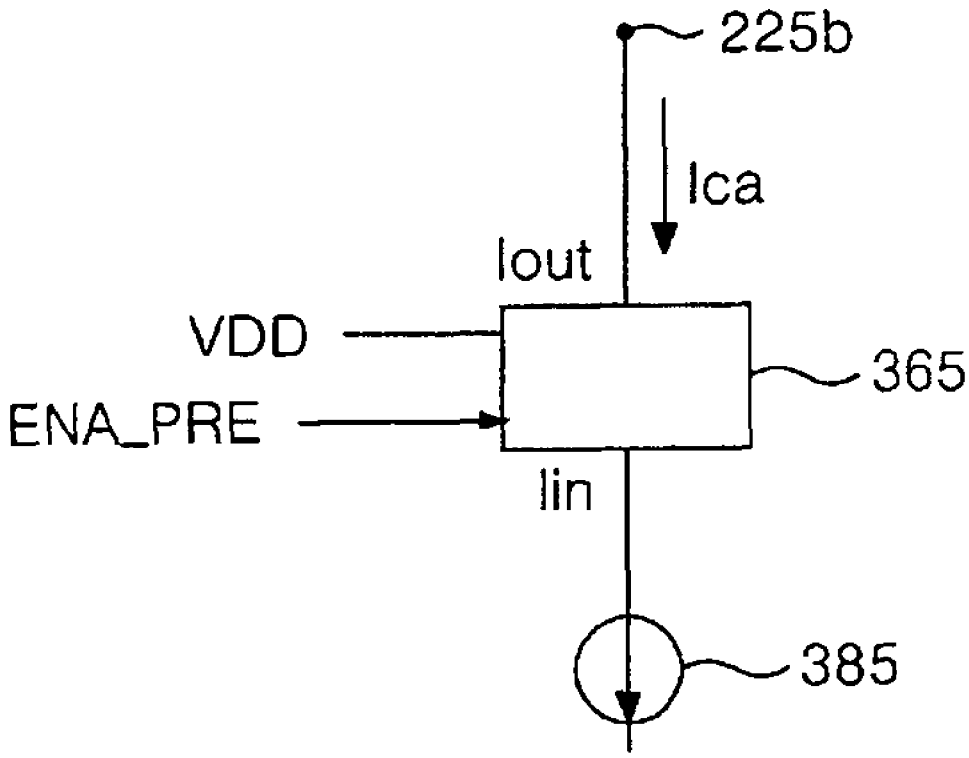
FIG. 19 is a circuit diagram of a current amplifier connected to one data line in an electro-luminescence display device according to a fifth embodiment of the present invention.
Figure 20:
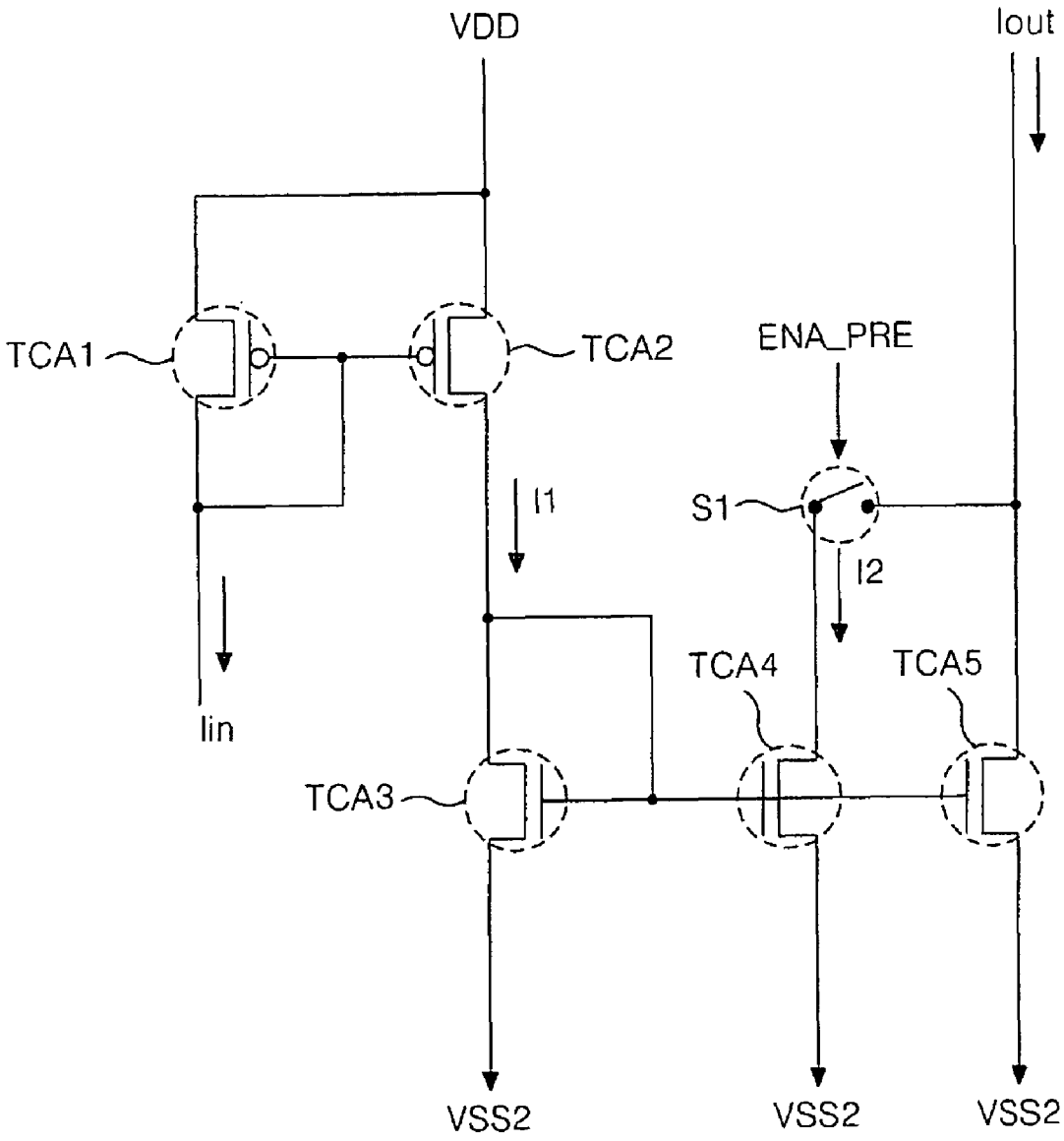
FIG. 20 is a detailed circuit diagram of the current amplifier shown in FIG. 19.

FIG. 19 is a circuit diagram of the current amplifier connected to one data line in an EL display device according to a fifth embodiment of the present invention. FIG. 20 is a detailed circuit diagram of the current amplifier shown in FIG. 19. The pixels and pre-charger of an EL panel connected to data line in the EL display device according to the fifth embodiment of the present invention are similar to those in the EL display device according to the fourth embodiment of the present invention.

The current amplifier shown in FIG. 19 includes a current amplifying unit 365 and a current source 385. The current amplifying unit 365 is connected to an external high voltage source VDD to amplify an input current Iin in response to a pre-charging current ENA_PRE and send an output current Iout. The current source 385 is an integrated circuit (IC) of the driving circuit 280, which plays a role in applying a current to the current amplifier. An amplifying current Ica flowing in the current amplifier becomes several to tens of larger current than a current output from the IC of the driving circuit when the pre-charging signal ENA_PRE is turned into an ON signal. In this case, a pixel current Ipix flowing in the first switching TFT TS1 of the pixel P and a pre-charging current Ipre at the pre-charger have a relationship of Ipre+Ipix=Ica or Ipre=Ica.

FIG. 20 is a circuit diagram of an example of the current amplifier shown in FIG. 19. As shown in FIG. 20, the current amplifying unit 365 includes a first amplifying transistor TCA1, a second amplifying transistor TCA2, a third amplifying transistor TCA3, a fourth amplifying transistor TCA4 and a fifth amplifying transistor TCA5. The first amplifying transistor TCA1 and the second amplifying transistor TCA2 are p-type transistors while the third amplifying transistor TCA3, the fourth amplifying transistor TCA4 and the fifth amplifying transistor TCA5 are n-type transistors. The first amplifying transistor TCA1 and the second amplifying transistor TCA2 have gate electrodes connected to each other, and are connected in parallel to the high voltage source VDD. The third amplifying transistor TCA3 is connected in series to the second amplifying transistor TCA2. The gate electrodes of the third amplifying transistor TCA3, the fourth amplifying transistor TCA4 and the fifth amplifying transistor TCA5 are connected to each other. A first switch S1 is provided between the fourth amplifying transistor TCA4 and the fifth amplifying transistor CA5 to be switched in response to the pre-charging signal ENA_PRE.

Since the current amplifier amplifies an input current Iin to send an output current Iout, W/L dimension ratios of the first to fifth amplifying transistors TCA1 to TCA5 are set such that a current I1 flowing in the second amplifying transistor TCA2 and a current I2 flowing in the fourth amplifying transistor TCA4 have relationships of Iin≦I1≦I2=Ipre; and Iout=Ipix with respect to the input current Iin, the output current Iout, the pixel current Ipix flowing in the first switching TFT TS1 and the pre-charging current Ipre at the pre-charger.

As described above, the EL display device according to the fifth embodiment of the present invention allows several to tens of times larger current than a current output from the IC of the driving circuit to flow into the data line during a certain period (i.e., the pre-charging interval t2) prior to a time when the data signal is input with the aid of the pre-charger and the current amplifier, thereby making a potential on the data line into a value close to a desired voltage. Accordingly, the time when the data signal is charged thereafter is shortened. Alternatively, even when the current amplifier is used without the above-mentioned pre-charger, the amplified current flows into the data line prior to an input of the data signal thereby allowing the data line to have a value close to a desired voltage so that the time for delivering the data signal into the driving thin film transistor can be shortened.

Figure 21:
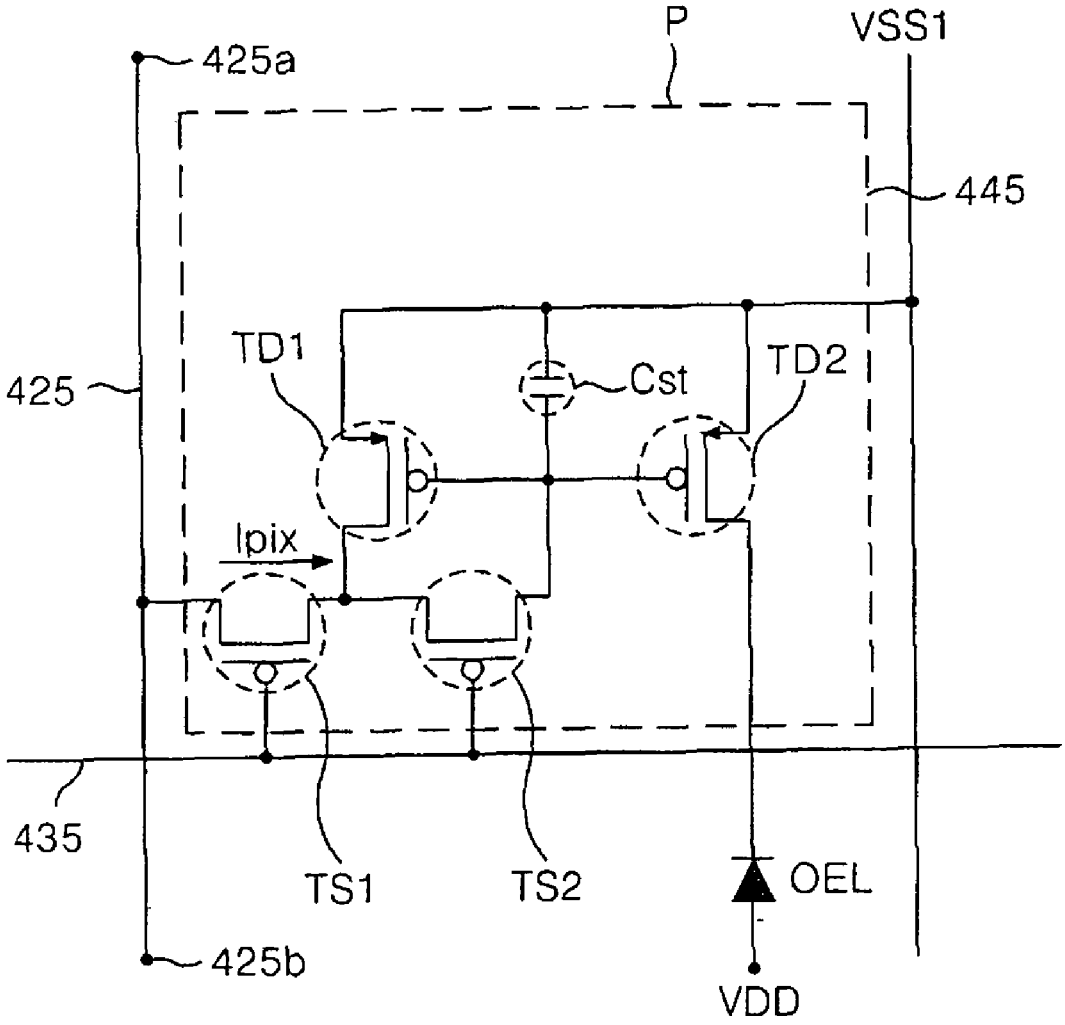
FIG. 21 is a circuit diagram of pixels of an electro-luminescence panel connected to one data line in an electro-luminescence display device according to a sixth embodiment of the present invention.
Figure 22:
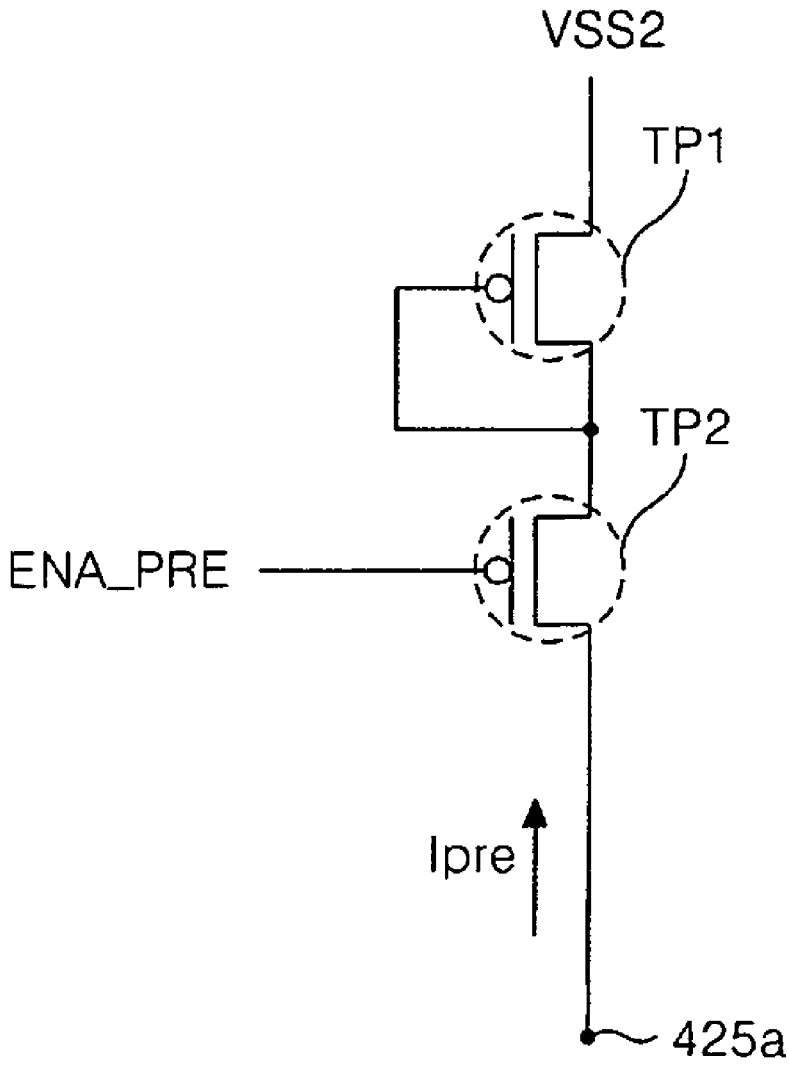
FIG. 22 is a circuit diagram of the pre-charger connected to one data line in the electro-luminescence display device according to the sixth embodiment of the present invention.
Figure 23:
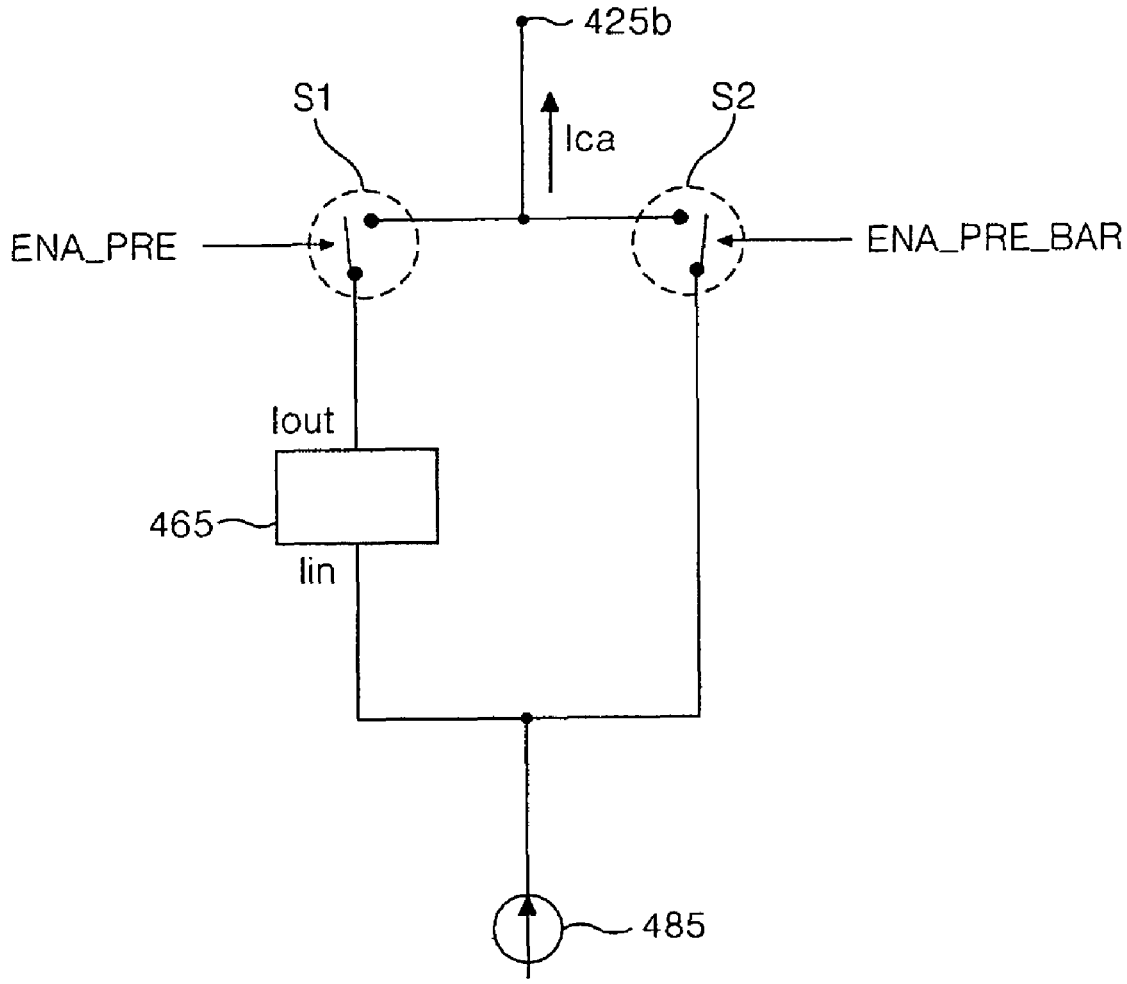
FIG. 23 is a circuit diagram of the current amplifier connected to one data line in the electro-luminescence display device according to the sixth embodiment of the present invention.

FIG. 21, FIG. 22 and FIG. 23 are circuit diagrams of pixels, a pre-charger and a current amplifier connected to one data line in an EL display device according to a sixth embodiment of the present invention, respectively. As shown in FIG. 21, each pixel P defined by a data line 425 and a scan line 435 is provided with a first switching thin film transistor TS1, a second switching thin film transistor TS2, a first driving TFT TD1 and a second driving TFT TD2, a storage capacitor Cst and a light-emitting cell OEL. The first switching thin film transistor TS1 and the second switching TFT TS2 are p-type transistors while the first driving TFT TD1 and the second driving TFT TD2 are n-type transistors. More specifically, the first switching TFT TS1 and the second switching TFT TS2 are connected in series to the data line 425. The gate electrodes of the first switching TFT TS1 and the second switching TFT TS2 are connected to the scan line 435. Gate electrodes of the first driving TFT TD1 and second driving TFT TD2 are connected to one electrode of the storage capacitor Cst while the other electrode of the storage capacitor Cst is connected to a power line 445. The second driving TFT TD2 is connected to the light-emitting cell OEL to control a current application from the power line 245, thereby implementing a picture.

If the scan line 435 is selected to turn on the first switching TFT TS1 and the second switching TFT TS2, then a data signal is input to the data line 425 and the gate electrodes of the first driving TFT TD1 and the second driving TFT TD2 along with an electrode of the storage capacitor Cst are charged. The second driving TFT TD2 can control an amount of a current from the power line 445 because an amount of an ON current is differentiated in accordance with the charged data signal. A first terminal 425*a* of the data line 425 is connected with the pre-charger of FIG. 22 while a second terminal 425*b* thereof is connected with the current amplifier of FIG. 23.

The pre-charger shown in FIG. 22 includes a first transistor TP1 and a second pre-charging transistor TP2 connected in series to a low voltage source VSS. The first pre-charging transistor TP1 is a n-type transistor while the second pre-charging transistor TP2 is a p-type transistor. A pre-charging signal ENA_PRE is input to the gate electrode of the second pre-charging transistor TP2, thereby applying a pre-charging current Ipre to the data line 425 during the pre-charging interval t2 shown in FIG. 14. The first pre-charging transistor TP1 and second pre-charging transistor TP2 may be manufactured to have a large W/L ratio such that they have several to tens of times larger current capacity than a current output from an integrated circuit of the driving circuitry.

The current amplifier shown in FIG. 23 includes a current amplifying unit 465, a first switch S1, a second switch S2 and a current source 485. The first switch S1 is switched in response to the pre-charging signal ENA_PRE while the second switch S2 is switched in response to an inverted pre-charging signal ENA_PRE_BAR having a polarity contrary to the pre-charging signal ENA_PRE. Thus, an amplifying current Ica flows through the current amplifying unit 465 during the pre-charging interval t2 while it flows not through the current amplifying unit 465 during the first interval t1 shown in FIG. 14. The current amplifying unit 465 amplifies an input current Iin and sends an output current Iout. The current source 485 is an integrated circuit (IC) of the driving circuit 280, and which plays a role to apply a current to the current amplifier. The amplifying current Ica flowing in such a current amplifier has a direction contrary to that in the fourth embodiment and becomes several to tens of times larger current than a current output from the IC of the driving circuit when the pre-charging signal ENA_PRE is turned into an ON signal. In this case, a pixel current Ipix flowing in the first switching TFT TS1 of the pixel P and a pre-charging current Ipre at the pre-charger have the following relationship.

$$Ipre+Ipix=Ica \text{ or } Ipre=Ica$$

As described above, the EL display device according to the sixth embodiment of the present invention allows several to tens of times larger current than a current output from the IC of the driving circuit to flow into the data line during a certain period (i.e., the pre-charging interval t2) prior to a time when the data signal is input with the aid of the pre-charger and the current amplifier, thereby making a potential on the data line into a value close to a desired voltage. Accordingly, the time when the data signal is charged thereafter is shortened. Alternatively, even when the current amplifier is used without the above-mentioned pre-charger, the amplified current flows into the data line prior to an input of the data signal, thereby allowing the data line to have a value close to a desired voltage so that the time for delivering the data signal into the driving thin film transistor can be shortened.

Figure 24:
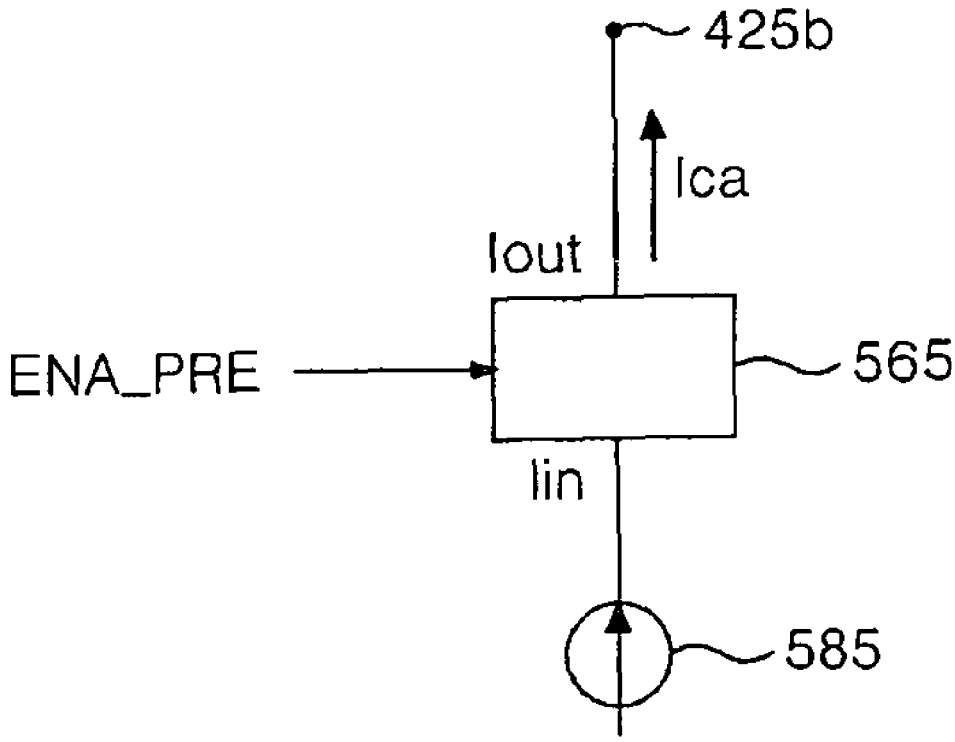
FIG. 24 is a circuit diagram of a current amplifier connected to one data line in an electro-luminescence display device according to a seventh embodiment of the present invention.
Figure 25:
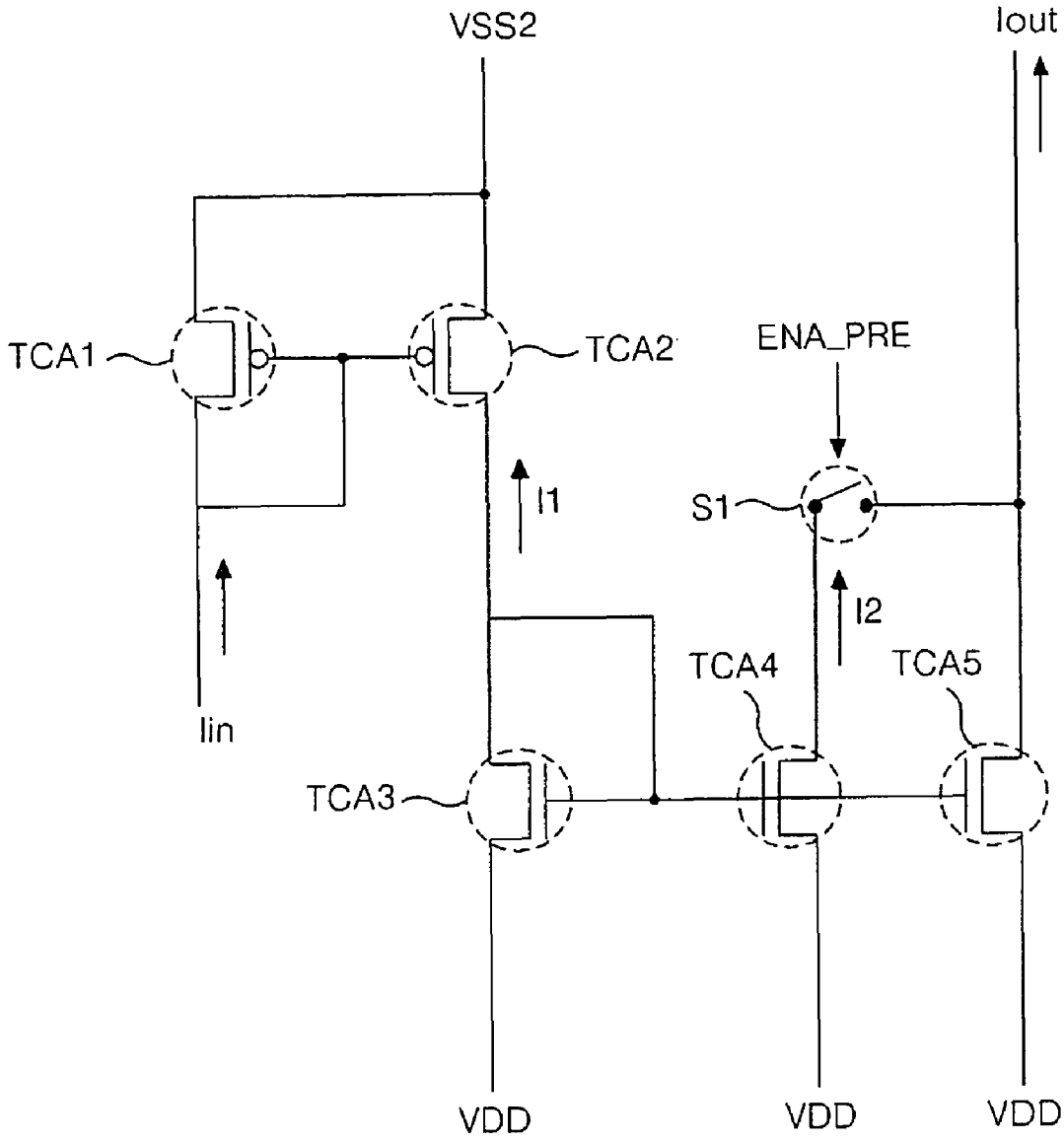
FIG. 25 is a detailed circuit diagram of the current amplifier shown in FIG. 24.

FIG. 24 is a circuit diagram of the current amplifier connected to one data line in an EL display device according to a seventh embodiment of the present invention. FIG. 25 is a detailed circuit diagram of the current amplifier shown in FIG. 24. The pixels and a pre-charger of an EL panel connected to one data line in the EL display device according to the seventh embodiment of the present invention are similar to those in the EL display device according to the sixth embodiment of the present invention shown in FIG. 21 and FIG. 22.

The current amplifier shown in FIG. 24 includes a current amplifying unit 565, and a current source 585. The current amplifying unit 565 amplifies an input current Iin in response to a pre-charging current ENA_PRE and sends an output current Iout. The current source 585 is an integrated circuit (IC) of the driving circuit 280, and which plays a role to apply a current to the current amplifier. The amplifying current Ica flowing in the current amplifier becomes several to tens of times larger current than a current output from the IC of the driving circuit when the pre-charging signal ENA_PRE is turned into an ON signal. In this case, a pixel current Ipix flowing in the first switching TFT TS1 of the pixel P and a pre-charging current Ipre at the pre-charger have a relationship of Ipre+Ipix=Ica or Ipre=Ica.

FIG. 25 is a circuit diagram of an example of the current amplifier shown in FIG. 24. As shown in FIG. 25, the current amplifying unit 565 includes a first amplifying transistor TCA1, a second amplifying transistor TCA2, a third amplifying transistor TCA3, a fourth amplifying transistor TCA4 and a fifth amplifying transistor TCA5. The first amplifying transistor TCA1 and the second amplifying transistor TCA2 are n-type transistors while the third amplifying transistor TCA3, the fourth amplifying transistor TCA4 and the fifth amplifying transistor TCA5 are p-type transistors. The first amplifying transistor TCA1 and the second amplifying transistor TCA2 have gate electrodes connected to each other, and are connected in parallel to a low voltage source VSS2. The third amplifying transistor TCA3 is connected in series to the second amplifying transistor TCA2. The gate electrodes of the third amplifying transistor TCA3, the fourth amplifying transistor TCA4 and the fifth amplifying transistor TCA5 are connected to each other.

A first switch S1 provided between the fourth amplifying transistor TCA4 and the fifth amplifying transistor TCA5 is switched in response to the pre-charging signal ENA_PRE. Since the current amplifier amplifies an input current Iin to send an output current Iout, W/L dimension ratios of the first to fifth amplifying transistors TCA1 to TCA5 are set such that a current I1 flowing in the second amplifying transistor TCA2 and a current I2 flowing in the fourth amplifying transistor TCA4 have relationships of Iin+I1+I2=Ipre; and Iout=Ipix with respect to the input current Iin, the output current Iout, the pixel current Ipix flowing in the first switching TFT TS1 and the pre-charging current Ipre at the pre-charger.

As described above, the EL display device according to the seventh embodiment of the present invention allows several to tens of times larger current than a current output from the IC of the driving circuit to flow into the data line during a certain period (i.e., the pre-charging interval t2) prior to a time when the data signal is input with the aid of the pre-charger and the current amplifier, thereby making a potential on the data line into a value close to a desired voltage. Accordingly, it becomes possible to shorten a time when the data signal is charged thereafter. Alternatively, even when the current amplifier only is used without the above-mentioned pre-charger, the amplified current flows into the data line prior to an input of the data signal, thereby allowing the data line to have a value close to a desired voltage so that the time for delivering the data signal into the driving thin film transistor can be shortened.

In the EL display devices according to the second to seventh embodiments of the present invention, the pre-charger and the current amplifier may be configured by an external circuit independent from the EL panel. Alternatively, they may be built into the EL panel like the switching thin film transistors and the driving thin film transistors provided at the pixels of the EL panel.

As described above, according to the present invention, a driving current applied to the pixels is pre-charged such that it is temporarily increased in a time interval when the scanning pulse is applied to the Nth scan line to be pre-charged, thereby reducing a driving time of the pixels. Accordingly, it becomes possible to prevent a delay in a charge and discharge time of the storage capacitor and the data line of the pixel cell caused by a low driving current. Further, according to the present invention, one pixel includes four thin film transistors and the pre-charger and the current amplifier for enlarging the driving current source so that a time when a signal is charged and discharged in the thin film transistors of the pixels can be shortened, and so that a uniformity problem caused by a change in a threshold voltage of the thin film transistor can be prevented by employing a current driving system.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro-luminescence display device comprising:

pixels provided between data lines and scan lines, each of the pixels including a light-emitting cell driven with a current;

a current controller for temporarily increasing the current for subsequent driving of the light-emitting cell;

a data driver to apply a data signal to the current controller;

a light-emitting cell controller to control the current applied to the light-emitting cell; and a timing controller to apply the data signal to the data driver, and generating a first selection signal, a second selection signal, a third selection signal, a third selection signal, a fourth selection signal, a fifth selection signal, a sixth selection signal, a pre-charging selection signal and a pre-charging enable signal, wherein the current controller includes:

a plurality of current sample holder portions connected to the data driver and the data line, and sampling the data signal from the data driver; and a plurality of pre-charging current suppliers connected between supply voltage lines and the data lines to apply a pre-charging current to the data lines.

2. The electro-luminescence display device according to claim 1, wherein each of the plurality of current sample holder portions includes:

a first sample holder portion having first to third sample holders commonly connected to an output line of the data driver to sample and store the data signals applied to the data lines whenever a scanning pulse is applied to the Nth scan line, wherein N is an integer;

a second sample holder portion having fourth to sixth sample holders commonly connected to the output line of the data driver to sample and store the data signals applied to the data lines whenever the scanning pulse is applied to the (N+1)th scan line; and a multiplexor array connected to each of the first sample holder portion, second sample holder portion and the data line to selectively connect each output line of the first and second sample holder portion to the data line in response to the pre-charging selection signal.

3. The electro-luminescence display device according to claim 2, wherein the first to third sample holders are sequentially driven in response to the first to third selection signals, and the fourth to sixth sample holders are sequentially driven in response to the fourth to sixth selection signals.

4. The electro-luminescence display device according to claim 3, wherein each of the first to sixth sample holders includes:

a sampler to sample and store the data signal connected to the output line of the data driver, a ground voltage source and the multiplexor array;

a first selection switch connected between the output line of the data driver and the sampler to be switched by one of the first to sixth selection signals; a second selection switch connected between a node positioned between the first selection switch and the sampler and the sampler to be switched by the selection signal applied to the first selection switch; and a third selection switch connected to the sampler and the output line connected to the multiplexor array to be switched by the pre-charging enable signal.

5. The electro-luminescence display device according to claim 4, wherein the sampler includes:

a first sampling switch connected between the first selection switch and the ground voltage source;

a second sampling switch connected to a gate terminal of the first sampling switch, the ground voltage source and the third selection switch;

a sampling capacitor connected between each gate terminal of the first and second sampling switches and the ground voltage source to store the data signal; and a third sampling switch connected to each gate terminal of the first and second sampling switches, the ground voltage source and the output line connected to the multiplexor array.

6. The electro-luminescence display device according to claim 5, wherein the second sampling switch has a relatively larger W/L dimension ratio than the first or third sampling switch.

7. The electro-luminescence display device according to claim 2, wherein the multiplexor array connects the second sample holder portion to the data line in a time interval when a scanning pulse is applied to the Nth scan line while connecting the first sample holder portion to the data line in a time interval when the scanning pulse is applied to the (N+1)th scan line in response to the pre-charging selection signal.

8. The electro-luminescence display device according to claim 2, wherein the first sample holder portion sinks a current from the pre-charging current supplier into the ground voltage source when the pre-charging enable signal is being applied with the aid of the data signal sampled and stored whenever a scanning pulse is applied to the Nth scan line whenever the scanning pulse is applied to the (N+1)th scan line, thereby temporarily increasing a current fed to the light-emitting cell largely; and the second sample holder portion sinks a current from the pre-charging current supplier into the ground voltage source when the pre-charging enable signal is being applied with the aid of the data signal sampled and stored whenever a scanning pulse is applied to the (N+1)th scan line whenever the scanning pulse is applied to the Nth scan line, thereby temporarily increasing a current fed to the light-emitting cell.

9. The electro-luminescence display device according to claim 3, wherein each of the pre-charging current supplier includes:

a current switch connected between the supply voltage source and the data line to be switched by the pre-charging enable signal;

a diode-type current supply switch connected between the current switch and the supply voltage source.

10. The electro-luminescence display device according to claim 9, wherein each of the pixels includes:

a driving thin film transistor connected between the supply voltage source and the light-emitting cell;

a first switching thin film transistor connected to the scan line and the data line;

a conversion thin film transistor connected to the supply voltage source, the driving thin film transistor and the first switching thin film transistor to form a current mirror with respect to the driving thin film transistor;

a storage capacitor connected between each gate terminal of the conversion and driving thin film transistors and the supply voltage source; and a second switching thin film transistor connected to each gate terminal of the conversion and driving thin film transistors, the scan line and the first switching thin film transistor.

11. The electro-luminescence display device according to claim 10, wherein the current supply switch has a relatively larger W/L dimension ratio than a W/L dimension ratio of the conversion thin film transistor.

12. A method of driving an electro-luminescence display device having pixels at intersections between data lines and scan lines and including light-emitting cells driven with a current, the method comprising the steps of:

sequentially sampling data signals applied to the data lines in a time interval when a scanning pulse is applied to the Nth scan line and storing them into a plurality of first sample holder portions, wherein each of the first sample holder portions is connected between one output line of a data driver and a plurality of data lines; and temporarily increasing a current flowing in the light-emitting cell largely using the data signals stored in the plurality of first sample holders in a time interval when the scanning pulse is applied to the (N+1)th scan line.

13. The method according to claim 12, wherein the step of temporarily increasing the current flowing in the light-emitting cell largely includes:

pre-charging the currents flowing in the data line and the light-emitting cell in such a manner to be temporarily increased largely.

14. The method according to claim 13, further comprising the steps of:

sequentially sampling the data signals applied to the data lines in a time interval when the scanning pulse is applied to the (N+1)th scan line to store them into a plurality of second sampling holder portions; and temporarily increasing a current flowing in the light-emitting cell largely using the data signals stored in the plurality of first sample holder portions in a time interval when the scanning pulse is applied to the Nth scan line.

15. The method according to claim 14, further comprising the step of:

generating a plurality of selection signals, a pre-charging selection signal and a pre-charging enable signal.

16. The method according to claim 15, wherein the plurality of first and second sample holders are selectively connected to the data lines in response to the pre-charging selection signal.

17. The method according to claim 16, wherein the plurality of first sample holders are connected to the data lines in response to the pre-charging selection signal in a time interval when the scanning pulse is applied to the (N+1)th scan line; and the plurality of second sample holders are connected to the data lines in response to the pre-charging selection signal in a time interval when the scanning pulse is applied to the Nth scan line.

18. The method according to claim 15, further comprising the step of:

applying a relatively large current to the data lines in response to the pre-charging enable signal.

19. The method according to claim 18, wherein a first path through which a relatively small current flows and a second path through which a relatively large current flows in accordance with the pre-charging enable signal are formed at each of the first and second sample holders.

* * * * *